United States Patent [19]

Fitzpatrick

[11] 4,187,644

[45] Feb. 12, 1980

[54] DUAL FEED APPARATUS FOR MULTIPLE SPINDLE HONING MACHINE

[75] Inventor: Paul Fitzpatrick, Southfield, Mich.

[73] Assignee: Ex-Cell-O Corporation, Troy, Mich.

[21] Appl. No.: 919,198

[22] Filed: Jun. 26, 1978

[51] Int. Cl.[2] ..... B24B 5/08

[52] U.S. Cl. ..... 51/34 D; 51/34 J; 51/165.93

[58] Field of Search ..... 51/34 R, 34 C, 34 D, 51/34 E, 34 G, 34 H, 34 J, 165.93, 340, 343, 344, 345

[56] References Cited

U.S. PATENT DOCUMENTS

| | | | |
|---|---|---|---|
| 1,990,331 | 2/1935 | Kern | 51/340 |
| 2,191,256 | 2/1940 | Dunbar . | |
| 2,317,079 | 4/1943 | Peden . | |
| 2,333,256 | 11/1943 | Kline . | |
| 2,343,275 | 3/1944 | Caldwell | 51/34 D |
| 2,741,071 | 4/1956 | Calvert | 51/34 C |
| 2,787,865 | 4/1957 | Gross | 51/34 C |
| 2,787,866 | 4/1957 | Gross | 51/34 C |
| 3,025,642 | 3/1962 | Swanson | 51/34 R |
| 3,286,409 | 11/1966 | Greenberg . | |
| 3,287,860 | 11/1966 | Blake . | |
| 3,352,067 | 11/1967 | Estabrook . | |
| 3,404,490 | 10/1968 | Estabrook | 51/34 D |
| 3,496,678 | 2/1970 | Engle | 51/344 X |
| 3,849,940 | 11/1974 | Yoshino | 51/34 C |
| 4,044,508 | 8/1977 | Frederick | 51/165.93 |

*Primary Examiner*—Gary L. Smith

*Attorney, Agent, or Firm*—Reising, Ethington, Barnard, Perry & Brooks

[57] ABSTRACT

A multiple spindle honing machine of the disclosure includes automatically controlled feed cylinders for initially expanding honing tools driven by the spindles and also includes a constant rate feed mechanism that continues to expand the tools after the initial expansion actuated by the feed cylinders. Each spindle includes a connector that extends between one of the feed cylinders and its associated honing tool. Mechanical locks respectively lock first threaded members of the connectors after the initial tool expansion. Second threaded members of the connectors are unthreaded from the first members thereof by an actuating member, preferably embodied by the gear rack, of the constant rate feed mechanism so as to continue the tool expansion and completion of honing operation. Electrical and hydraulic circuits control operation of the pressure feed cylinders, the constant rate feed mechanism, and the mechanical locks. Each honing tool is automatically contracted independently of the other tools after the bore being machined thereby reaches the required size and, after all of the tools are contracted, the feed cylinders may be actuated to re-expand the tools for a finishing operation.

32 Claims, 20 Drawing Figures

DUAL FEED APPARATUS FOR MULTIPLE SPINDLE HONING MACHINE

TECHNICAL FIELD

This invention relates to feed apparatus for a multiple spindle honing machine and, more particularly, to such apparatus which has a dual feed for automatically expanding the tools rapidly upon insertion within bores to be machined and for subsequently expanding the tools at a constant rate until the required bore size is reached whereupon each tool is individually contracted independently of the other tools.

BACKGROUND ART

Honing machines conventionally include a base on which a spindle head is mounted for reciprocally driven movement. A rotatable spindle mounted on the head rotates a honing tool which includes stones for performing the honing operation. Movement of the head from a withdrawn position to an operating position locates the tool within the bore to be machined whereupon the stones of the tool are expanded to perform the honing operation. Rotation of the tool by the spindle and concomitant reciprocal movement of the head on which the spindle is supported provides the stones with both rotational and axial movement during the machining is completed and withdrawal of the spindle head allows the machined part to be removed in preparation for another cycle.

Honing is usually utilized after a boring operation to accurately machine the bore and correct inaccuracies in the straightness or roundness as well as providing a smooth surface finish. Usually the amount of material stock removed is not particularly great; but, certain honing operations are performed with relatively coarse stones so as to greatly increase the size of the bore.

One type of honing machine incorporates a hydraulic feed cylinder for actuating expansion of the honing tool stones during the honing operation. Expansion of the stones is thus dependent on the pressure of the hydraulic fluid supplied to the feed cylinder. Resistance to the machining at the interfaces of the stones and the bore can slow or completely stop the stone expansion. For example, if the stones become glazed before the honing is completed, the pressure supplied to the feed cylinder may not be great enough to actuate the outward stone expansion so that the machining can be completed.

Honing machines which incorporate hydraulic fluid actuated feed cylinders are disclosed by U.S. Pat. Nos. 2,317,079; 2,333,256; 2,741,071; 2,787,865; 2,787,866; and 3,352,067.

Honing machines have also incorporated temperature sensing to sense the heat generated during the honing in order to control the pressure applied to the stones for actuating their expansion. See for example U.S. Pat. Nos. 2,191,256 and 3,287,860. Also, U.S. Pat. No. 3,404,490 discloses a honing machine having an electrical circuit that senses the resistance to stone expansion and varies the expansion force applied to the stones by an electric motor expansion mechanism.

U.S. Pat. Nos. 3,286,409 and 4,044,508 disclose single spindle honing machines having feed actuators for providing an initial fast stone expansion that engages the stones with the bore surface to be honed and a subsequent slower stone expansion as the machining takes place.

U.S. Pat. No. 3,849,940 discloses a honing machine having a pressure feed cylinder and a constant rate feed mechanism for providing stone expansion depending upon which has the higher feed rate as the machining takes plce. Also, single spindle honing machines have incorporated a pressure feed cylinder that is locked after the initial stone expansion so that a constant rate feed mechanism can subsequently expand the stones. Locking takes place at a connector that extends between the cylinder and the honing tool. A threaded connection of the connector is then unthreaded by the constant rate feed mechanism to expand the stones at a constant rate.

Stones of different coarseness are used to perform coarse and finishing honing operations. Usually the coarse stones are mounted on one honing tool and the finer stones are mounted on another tool. However, coarse and fine stones have also been mounted on the same tool and selectively expanded and contracted to first perform the coarse honing operation and subsequently perform the finer honing operation which finishes the bore. See U.S. Pat. No. 3,496,678.

Multiple spindle honing machines are used to simultaneously hone a plurality of bores such as, for example, the bores of an engine block. Different bores of the engine block will normally have different initial sizes so that the time required to hone the bores to the same size will vary.

DISCLOSURE OF THE INVENTION

An object of the present invention is to provide improved feed apparatus for a multiple spindle honing machine having a reciprocal spindle head with a plurality of rotatable spindles mounted thereon and including respective expandable and contractable honing tools for simultaneously machining a number of bores.

In carrying out the above object and other objects of the invention, the feed apparatus includes a plurality of feed cylinders mounted on the reciprocal spindle head in respective association with the honing tools. Each spindle includes a connector that connects one of the feed cylinders and the associated honing tool such that operation of the feed cylinders provides an initial expansion of the tool upon head movement which inserts the tools into the bores to be honed. Mechanical locks respectively lock the feed cylinders after the intial tool expansion. A constant rate feed mechanism continues to expand all of the tools after the feed cylinders are locked. Electrical and hydraulic control circuits provide a means for individually sensing the size of each bore being machined and for automatically operating the associated mechanical lock to unlock the feed cylinder controlled thereby to allow the feed cylinder to contract the tool independently of each other tool when the bore has been machined to a predetermined size.

Each connector of the feed apparatus includes a first threaded member connected to the associated feed cylinder and a second threaded member which is threaded to the first member and connected to the associated honing tool. Movement of each connector by its associated feed cylinder actuates the stones of the honing tool connected thereto so as to provide the initial stone expansion which engages the stones with the surface of the bore to be honed. An actuating member of the constant rate feed mechanism interconnects the second threaded members of the connectors and provides unthreading thereof from the first threaded members to provide constant rate stone expansion after the mechanical locks lock the first threaded members of the connectors against movement.

Each of the mechanical locks includes a lock member that locks the first threaded member of the associated member against movement, and each lock also includes an actuator that comprises a hydraulic cylinder for operating the lock member. A pivotal support mounts each lock member on the reciprocal spindle head. A locking end of the lock member preferably has a curved surface and is moved by the lock member movement to lock the associated first threaded member of the connector. A connection end of each lock member is connected to the associated actuating cylinder such that operation of the cylinder moves the lock member between locking and nonlocking positions. A housing of the reciprocal spindle head supports the first threaded member of each connector and each lock includes an axial force isolator interposed between the curved locking end of the lock member and the first threaded member such that locking of the first threaded member by the lock member does not apply any axial force to the connector. A mounting portion of each first threaded member is slidably supported on the housing on the spindle head and engaged by the axial force isolator under the operation of the mechanical lock to control movement of the connector by operation of the associated feed cylinder.

The actuating member of the constant rate feed mechanism preferably takes the form of a gear rack and the second threaded members of the connectors include teeth that are meshed with the gear rack. Movement of the gear rack rotates the second threaded members of the connectors to provide unthreading thereof from the first threaded members as each second member moves axially during its rotation and thereby slides transversely with respect to the direction of rack movement. A hydraulic operating cylinder moves the gear rack to provide the constant rate feed which expands the stones during the honing. After a predetermined extent of rack movement, a sensor is actuated to switch the rack movement from a coarse to a fine constant feed rate. The sensor is disclosed as including a control switch mounted on the spindle head and a switch actuator mounted on the rack. An adjustable connection preferably mounts the switch actuator on the rack so that its position can be changed along the length of the rack to allow adjustment of the point at which the rack is switched from the coarse to the fine constant feed rate.

Each spindle of the apparatus includes a rotatable drive member having a gear driven end and an end connected to the associated honing tool. A central opening of each drive member receives the tool connector which extends between the tool and the associated feed cylinder. A gear drive train on the spindle head includes gears that are meshed with the gear driven ends of the tool drive members and which are driven by a rotatable ball spline on the machine base as the spindle head is reciprocated on a base of the machine.

Electrical and hydraulic circuits control the operation of the feed cylinders, the mechanical locks, and the operating cylinder for the gear rack of the constant rate feed mechanism. Circuitry of the electrical and hydraulic circuits is preferably also provided for re-expanding the tools under the impetus of the feed cylinders in order to surface finish the bores after the bores have been sized. Lock valves of the circuits are respectively associated with the lock cylinders and operated by the pressurized hydraulic fluid which also operates the associated feed cylinder. A master lock valve controls the flow of hydraulic fluid to the lock valves and is operated by a time-delayed solenoid so as to allow the initial expansion of the tools by the feed cylinders before the mechanical locks lock the connectors. Feed valves control the flow of pressurized hydraulic fluid to the feed cylinders and the flow of pressurized hydraulic fluid that operates the lock valves. Solenoids operate the feed valves and are actuated upon the initial full insertion of the tools within the bores being honed. A solenoid actuated supply valve controls the supply of pressurized hydraulic fluid to the rack operating cylinder. A coarse and fine rate feed valve is solenoid actuated and controls the flow of hydraulic fluid from the rack operating cylinder so as to initially provide the coarse rate of tool expansion and the subsequent fine rate of expansion by the constant rate feed mechanism.

Each of the feed cylinders includes an associated wear indicating switch mounted on the spindle head and a switch actuator mounted for movement with the feed cylinder piston. Actuation of any one of these switches indicates piston movement which is indicative of excessive tool stone wear that necessitates replacement of the stones. Machine operation is automatically terminated by the stone wear switch actuation.

The objects, features, and advantages of the present invention are readily apparent from the following description of the best mode for carrying out the invention when taken in connection with the accompanying drawings.

BEST MODE FOR CARRYING OUT THE INVENTION

Figure 1:
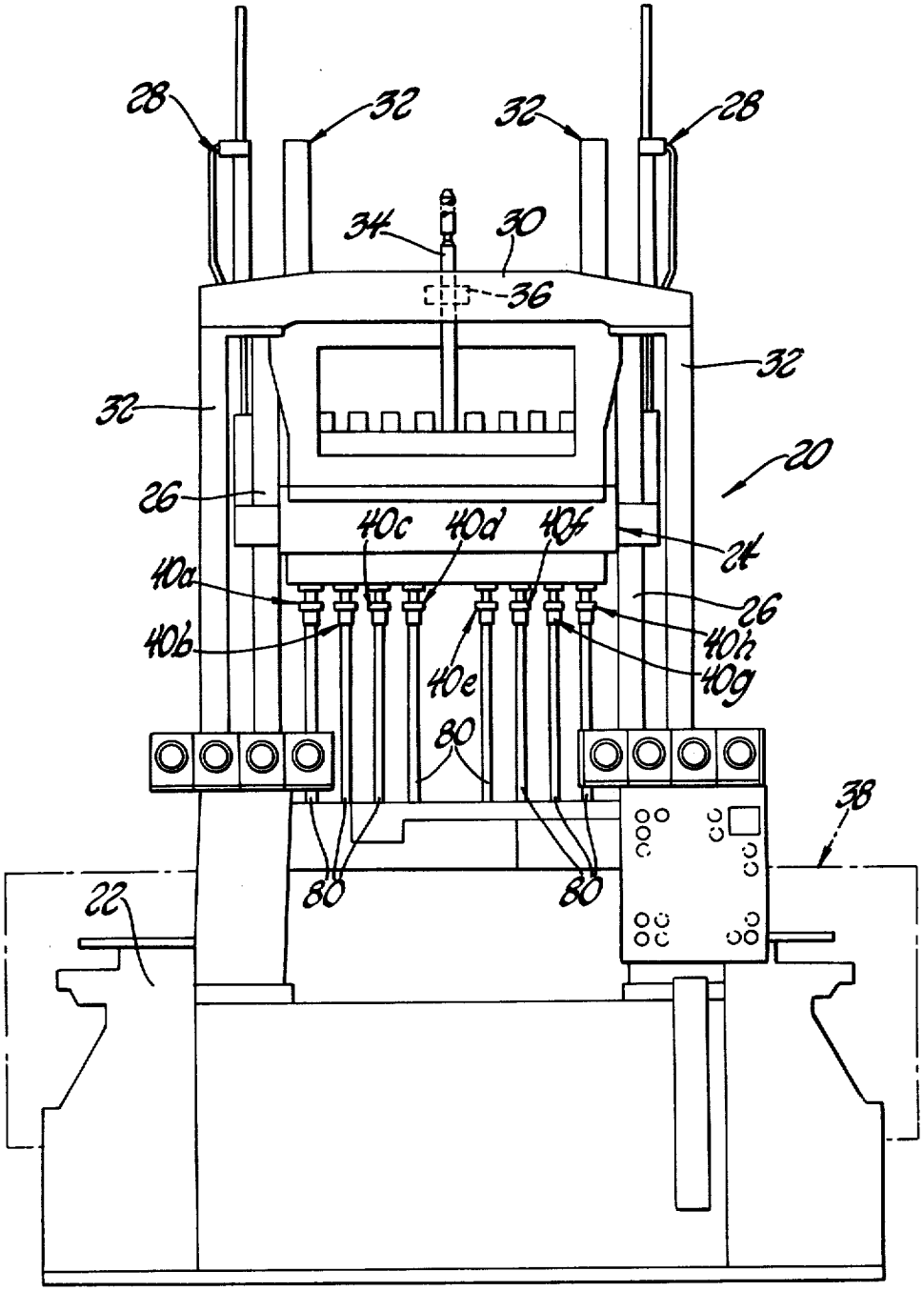
FIG. 1 is a front elevation view of a honing machine embodying feed apparatus according to the present invention.

Referring to FIG. 1 of the drawings, a honing machine embodying apparatus constructed according to the present invention is indicated generally by reference numeral 20 and includes a floor base 22 on which a vertically reciprocal spindle head 24 is mounted by a pair of vertical guide bars or slide tubes 26. Spindle head 24 is driven upwardly and downwardly by a pair of hydraulic drive cylinders 28 whose pistons are of the double-rod end type such that the distance required to drive the spindle head requires the same displacement volume of hydraulic fluid in either direction. Drive cylinders 28 are supported on a stationary base head 30 which interconnects vertically extending base supports 32 that extend upwardly from the floor base 22. Stationary base head 30 also supports a pair of air counterbalance cylinders 32 for counterbalancing the force of gravity acting on the spindle head 24 as it is driven upwardly and downwardly by the drive cylinders 28. A latch rod 34 extends upwardly from the spindle head 24 through a suitable opening (not shown) in the stationary base head 30 and is operated on by a latch mechanism 36 to hold the spindle head in an upper withdrawn position. Below the spindle head 24 is a schematically indicated conveyor mechanism 38 for conveying parts such as engine blocks having bores to be honed by the machine in a manner which is more fully hereinafter described.

Figure 2A:
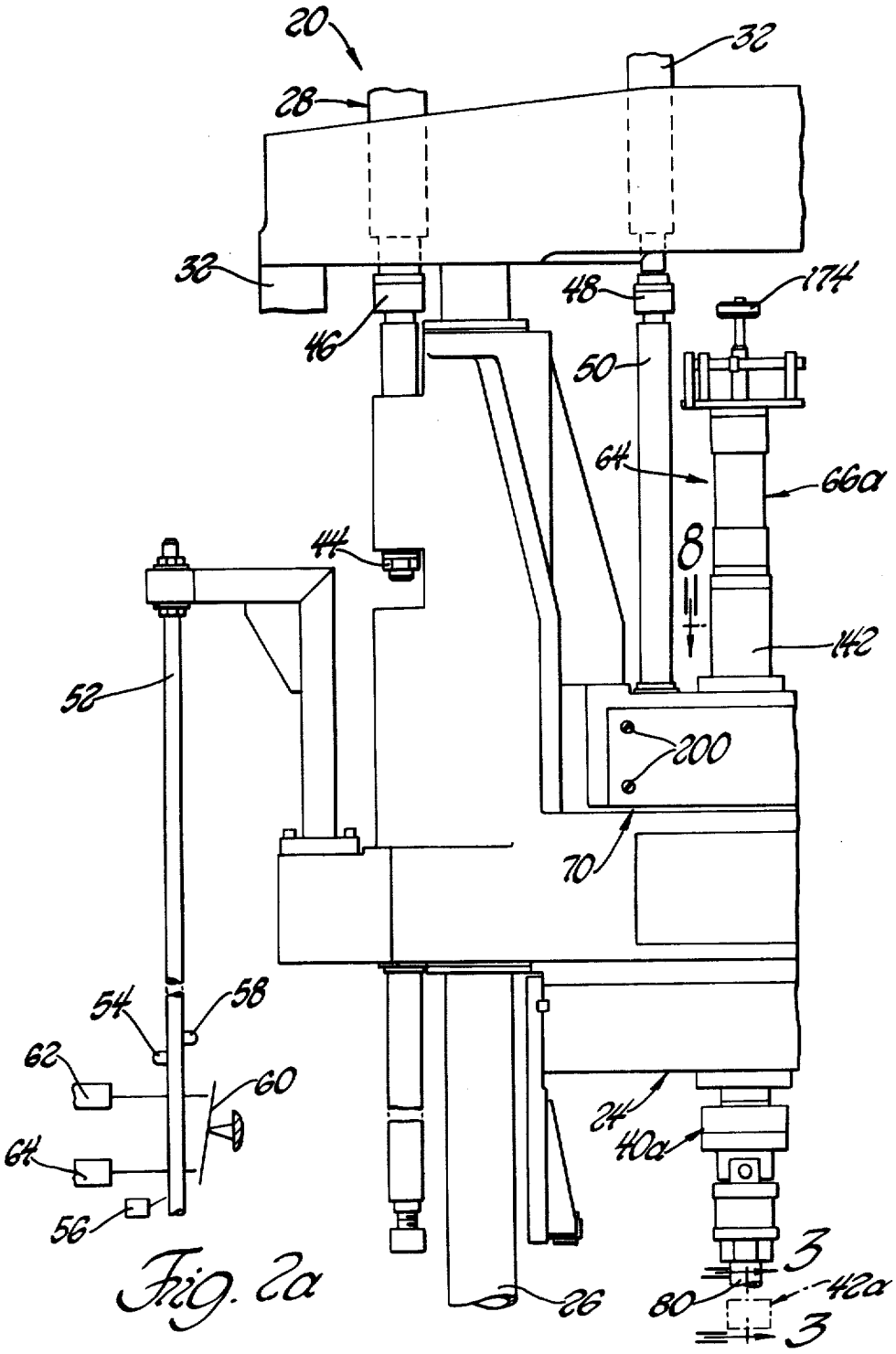
FIGS. 2*a*, 2*b*, and 2*c* taken collectively in alphabetical order from the left to the right illustrate an enlarged portion of the machine shown in FIG. 1 but with certain portions removed to illustrate components which are hidden in FIG. 1.
Figure 2B:
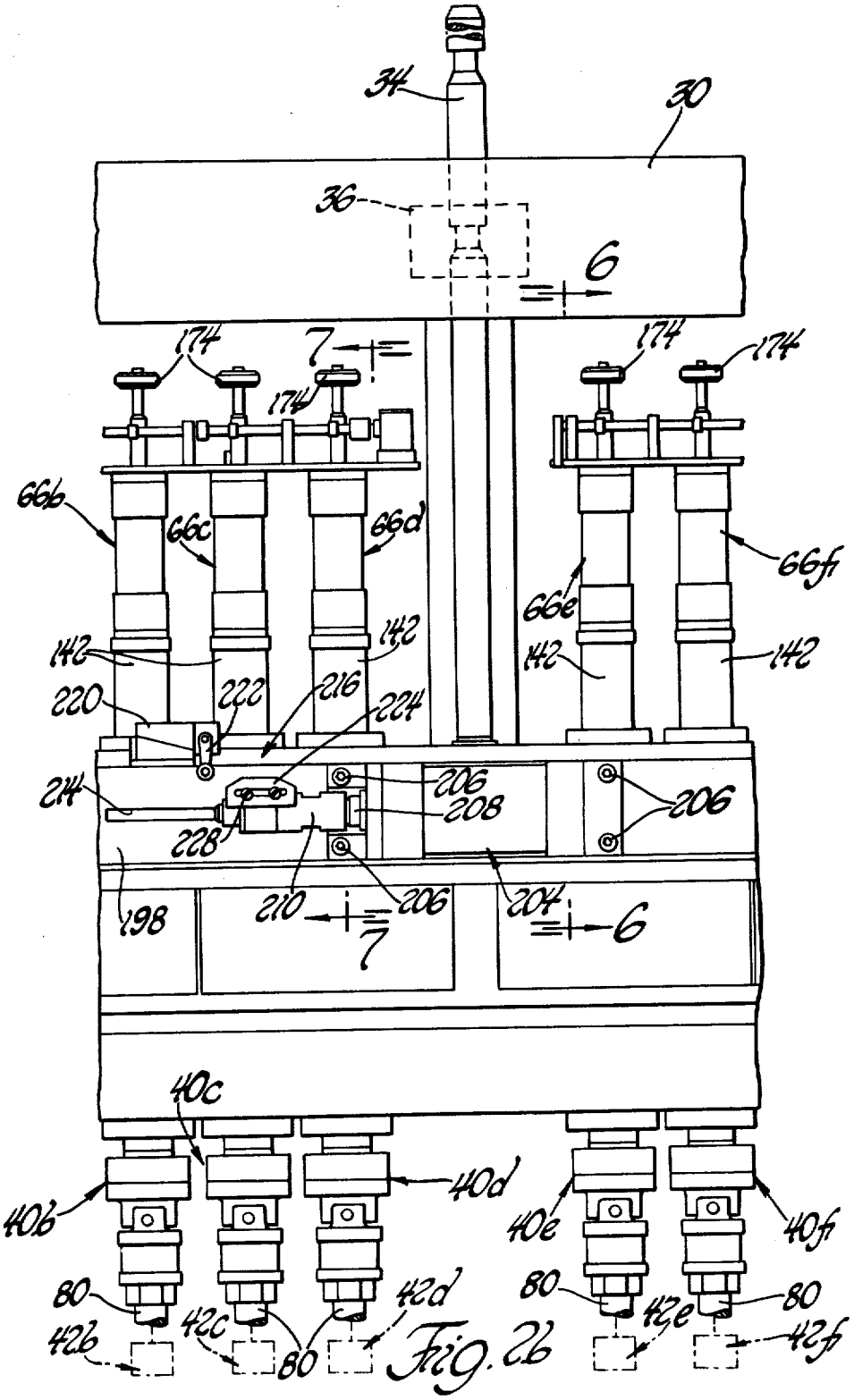
Figure 2C:
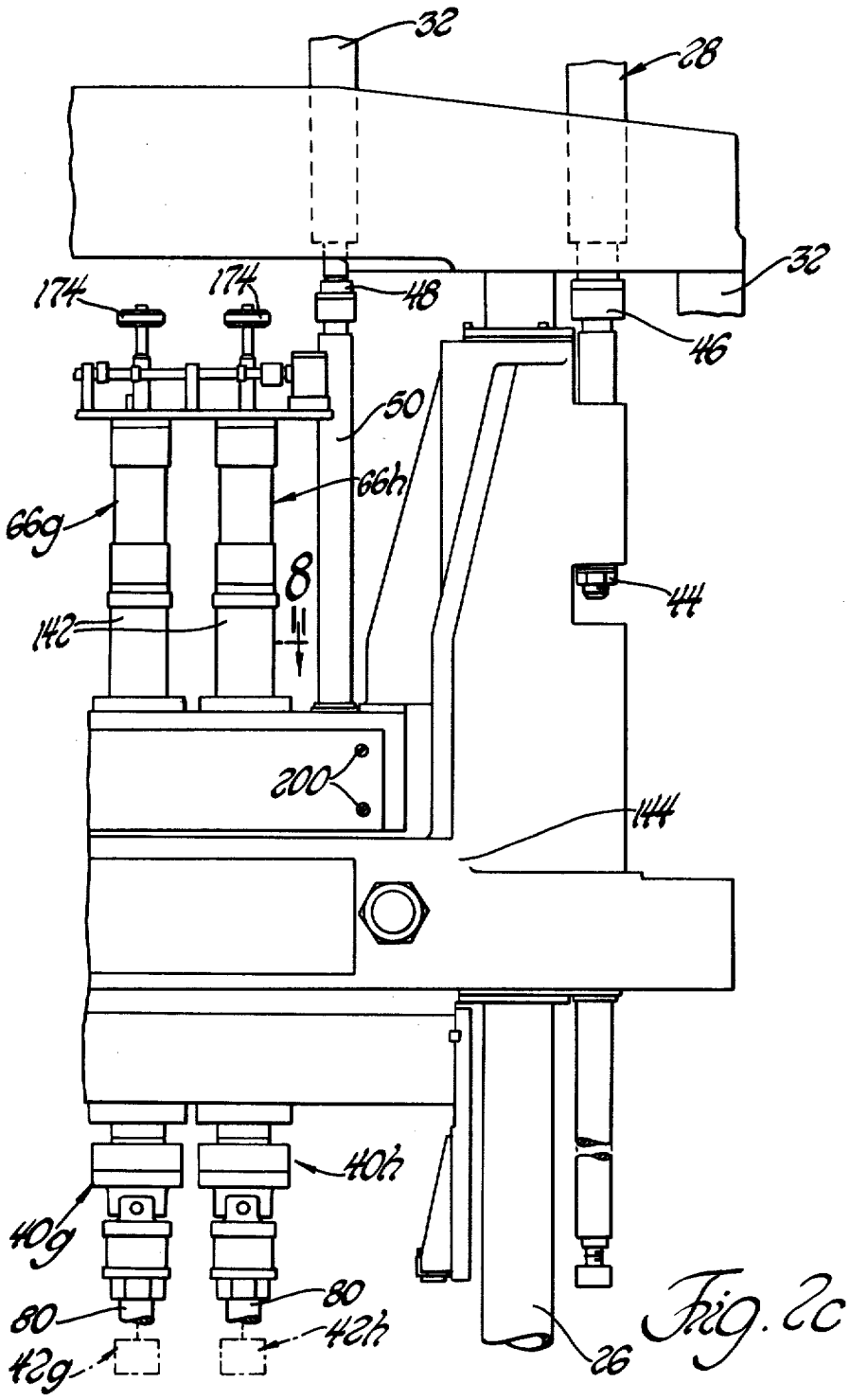

With continuing reference to FIG. 1 and additional reference to FIGS. 2*a*, 2*b*, and 2*c* taken collectively, spindle head 24 includes a plurality of rotatable spindles 40*a* through *h* which extend in a downward direction. Expandable and contractable honing tools 42*a* through *h* are supported on the lower ends of the spindles as shown schematically in FIGS. 2*a*, *b*, and *c* between the slide tubes 26 by which the spindle head 24 is mounted for upward and downward movement. Opposite ends of the spindle head are secured on the opposite outer sides of the slide tubes 26 by threaded studs and bolt connections 44 to the piston connecting rods 46 of the adjacent hydraulic drive cylinders 28. Upon commencement of a machining cycle as will be more fully hereinafter described, the drive cylinders 28 drive the spindle head 24 downwardly from the upper withdrawn position shown so that the honing tools 42*a* through *h* are received within respective bores ready for a honing operation. The honing tools are in a contracted condition upon the initial insertion within the bores such that there is no interference between the tools and the part or workpiece. The air counterbalance cylinders 32, whose piston connecting rods 48 are secured to the spindle head 24 by connections 50 between the slide tubes 26, are compressed by the downward spindle head movement such that subsequent driving movement of the spindle head in an upward direction is assisted by the counterbalance cylinders.

Upon the initial downward stroke of the spindle head 24, a control rod 52 (FIG. 2*a*) moves a switch dog 54 downwardly to trip a limit switch 56 that actuates rotation of the spindles 40*a* through *h*. Another dog 58 on rod 52 pivots a valve actuator 60 counterclockwise upon reaching the bottom of the stroke in order to actuate a valve 62 so as to reverse the direction the drive cylinders 28 move the spindle head in a manner which is more fully hereinafter described. Upon upward movement the dog 58 pivots the valve actuator 60 clockwise to actuate a valve 64 which again switches the direction of spindle head movement.

Figure 7:
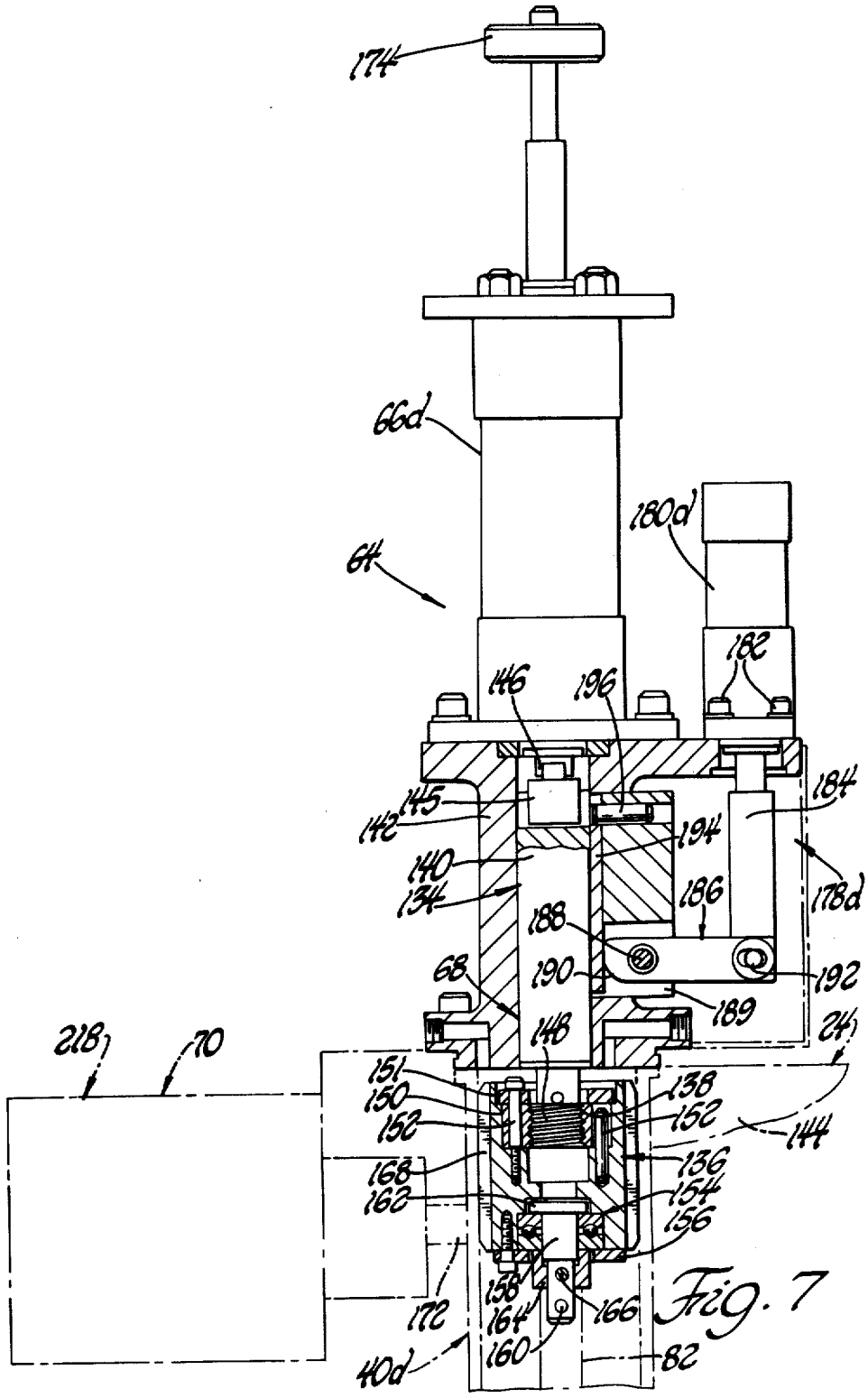
FIG. 7 is an enlarged view of the honing machine taken partially in section along line 7—7 of FIG. 2*b;*

A pressure type feed collectively indicated by 64 in FIGS. 2*a*, *b*, and *c* includes hydraulic feed actuators or cylinders 66*a* through *h* which are connected to the associated honing tools 40*a* through *h* by respective connectors 68, FIG. 7. After initial expansion of the honing tools by the pressure feed 64, a constant rate feed mechanism indicated collectively by reference numeral 70 in FIGS. 2*a*, *b*, and *c* and 7 continues to expand the honing tools at a constant rate as the spindles rotate the tools and the spindle head simultaneously reciprocates the tools. A hydraulic control circuit indicated collectively by 72 in FIGS. 11*a*, *b*, *c*, *d*, and *e* and an electrical control circuit indicated collectively by 74 in FIGS. 12*a* and *b* cooperate to control operation of the pressure feed 64 and the constant rate feed mechanism 70 as is more fully hereinafter described. Each honing tool 42*a* through *h* as shown in FIGS. 2*a*, *b*, and *c* is contracted independently of the other tools when the bore in which it is machining reaches the required size.

Figure 5:
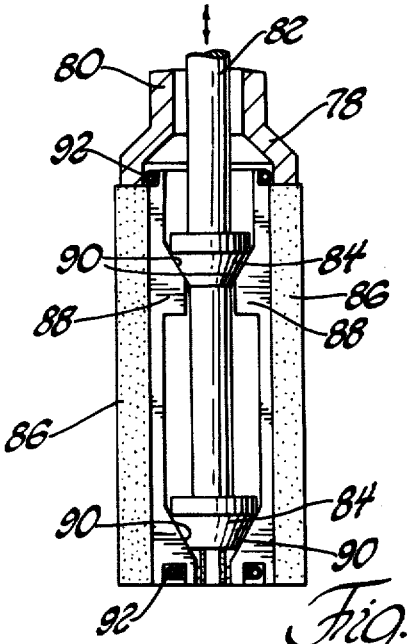
FIG. 5 is a sectional view of the honing tool taken along line 5—5 of FIG. 4.

Referring to FIGS, 3, 4, and 5, honing tool 42*a* will now be described along with a decription of an associated gauge assembly 76*a* with the understanding that each of the other honing tools has a similar construction and gauge assembly. Tool 42*a* includes a metallic body 78 which is fixedly connected to the lower end of an elongated rotary drive member 80 of the associated spindle. A connector rod 82 of the associated feed cylinder connector 68 extends downwardly through a central opening of the drive member 80 and has a lower end shown in FIG. 5 which includes cones 84 for controlling the expanded or contracted condition of circumferentially spaced stones 86. Each stone extends outwardly through a vertical slot in the tool body 78 and is secured in a suitable manner such as by an adhesive bond or a mechanical fastener to an associated metal holder 88. Inclined surfaces 90 of the stone holders 88 are biased into engagement with the cones 84 by a pair of ring-shaped springs 92 received by the upper and lower ends of the stone holders. Upward and downward movement of the connector rod 82 relative to the tool body 78 controls inward and outward radial movement of the stones 86.

Figure 3:
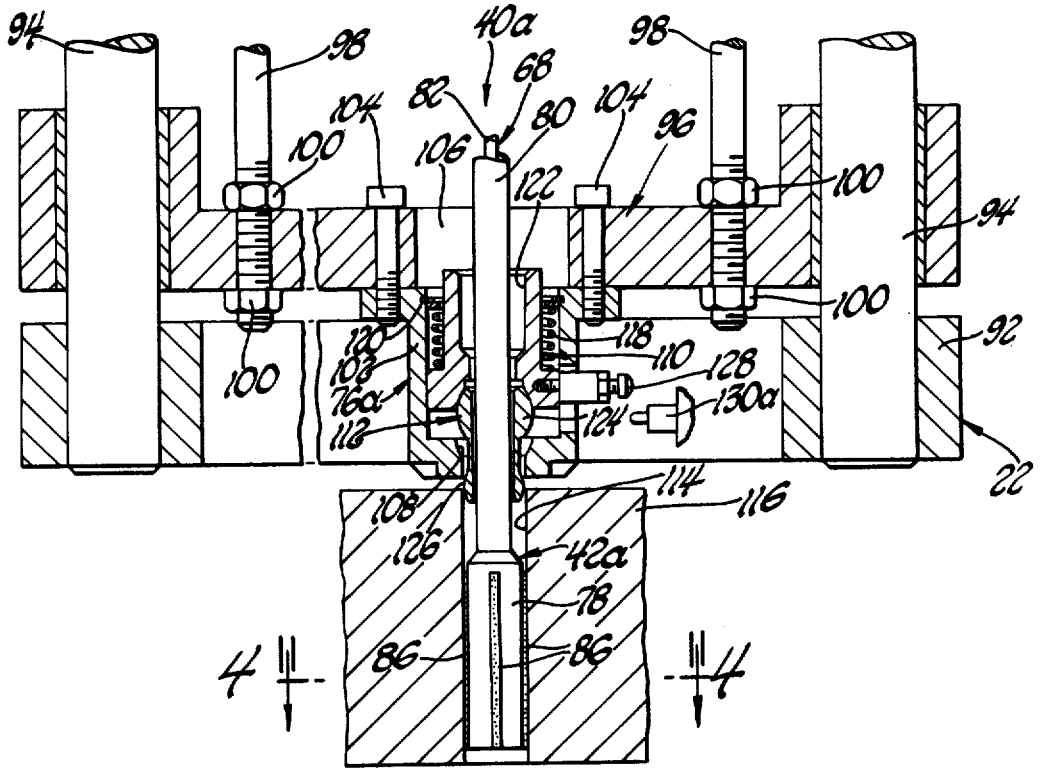
FIG. 3 is a sectional view of the honing machine taken generally along line 3—3 of FIG. 2 and shows one of the expandable and contractable honing tools of the machine and a gauge assembly for sensing the size of a bore being machined by the tool.
Figure 4:
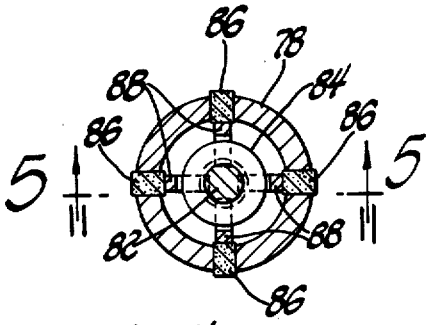
FIG. 4 is a sectional view of the honing tool taken along line 4—4 of FIG. 3.

As seen by reference to FIG. 3, the machine base 22 includes a base portion 92 that fixedly supports a pair of vertical slide shafts 94 on which a gauge frame 96 is slidably supportded for vertical movement with the spindle head 24. Connector rods 98 have lower threaded ends which are secured to frame 96 by nuts 100 and have upper ends which are secured in a suitable manner to the spindle head so that the frame 96 is thereby driven upwardly and downwardly on the slide shafts 94 in a reciprocal fashion with the spindle head. Each of the gauge assemblies is mounted like the one gauge assembly 76*a* shown in the lower side of the frame 96. A hollow housing 102 of the gauge assembly 76*a* has an upper flange which is secured by bolts 104 to the frame with the associated rotary drive member 80 extending downwardly through an opening 106 in the frame and downwardly through a lower opening 108 in the housing. A plug retainer 110 and a gauge plug 112 are mounted within the housing 102 and cooperate upon each downward stroke of the spindle head to sense the diameter of the bore 114 in the workpiece 116 being honed. A helical spring 118 encircles the plug retainer 110 and has an upper end seated against a snap ring 120 on the housing 102 and a lower end seated against a lower flange of the plug retainer so that the plug retainer is biased downwardly in a resilient fashion. A central opening 122 of the plug retainer 110 receives the rotary drive member 80 and the rod 82 of the connector 68 therein such that these components extend downwardly for connection to the associated honing tool 42*a* in the manner previously described.

Gauge plug 112 shown in FIG. 3 has an upper spherical portion 124 that is seated within a partially spherical lower end of the retainer opening 122 and also has a lower spherical portion 126 of a diameter than corresponds to the final bore diameter. At the upper extent of each reciprocal stroke during the honing operation, the upper spherical portion 124 of the plug is seated by the cooperable action of the plug retainer 110 and the spring 118 within the upper end of the housing opening 108. Prior to the bore 114 reaching size, each downward stroke of the tool engages the lower spherical portion 126 of the gauge plug 112 with the outer end of the bore such that the gauge plug is moved upwardly relative to the housing 102 against the bias of the spring 118. A swtich actuator 128 is fixedly mounted on the plug retainer 110 and moves downwardly toward an associated limit switch 130*a* during each stroke. However, the upward movement of the gauge plug 112 and the plug retainer 110 prevents the switch 130*a* from being tripped by the actuator 128. When bore 114 reaches the required diameter, the plug portion 126 can move downwardly into the bore at the downward extent of the spindle head stroke and the plug 112 then does not move relative to the housing 102 so that the switch actuator 128 actuates its associated limit switch 130*a* to initiate collapsing or contraction of the tool stones 86 and completion of the honing cycle in a manner which is more fully hereinafter described. It should be noted that the upward extent of the spindle head stroke is not great enough to withdraw the tool stones 86 from the bore 114 so that the downward stroke commences without any interference between the stones and the bore despite the outward bias on the stones.

Connectors 68 shown in FIGS. 6 and 7 will now be described together with a description of the operation of the pressure feed 64 shown by these views and the constant rate feed mechanism 70 shown in FIGS. 6, 7, 8, and 9. This description will be followed by a description of the gear drive train 132 shown in FIGS. 6 and 10 for rotating the spindles and a following description of the hydraulic and electrical control circuits of FIGS. 11*a* through *e* and 12*a* and *b* that control operation of the machine.

Referring particularly to FIG. 7, each connector 68 includes first and second threaded members 134 and 136 that are secured to each other by a threaded connection 138. The first threaded member 134 includes a mounting portion 140 that is slidably received within a housing portion 142 of the spindle housing 144. Mounting portion 140 is slidably movable upwardly and downwardly but has a square or other suitable cross section that prevents rotation about a vertical axis. An upper end of the mounting portion 140 is secured by a coupling 145 to the piston connecting rod 146 of the associated hydraulic feed cylinder 66*d*. A lower end 148 of the first member 134 includes male threads that are received by female threads of an insert 150 of the second threaded member 136. A retainer 151 and bolts and pins 152 cooperate to secure the threaded insert of the second threaded member. An anti-friction thrust bearing 154 is secured to the lower side of the second threaded member 136 by a bolted ring retainer 156 and rotatably supports a coupling 158 that is rotatably fixed to the upper end of the connector rod 82 by a pin 160. Upper flange 162 of the coupling 158 engages the upper race of the bearing 154 while a fitting 164 that is secured to the coupling by a pin 166 engages the lower race of the bearing. Hydraulic fluid supplied to the cylinder 66*d* moves the connector 68 upwardly and downwardly to control the expanded or contracted condition of the associated honing tool in the manner previously described. It should be noted that the second threaded member 136 takes the form of a spur-type gear having teeth 168 that mesh with teeth 170 (FIG. 6) on a actuating member or gear rack 172 of the constant rate feed mechanism 70. Gear teeth 168 slide upwardly and downwardly with respect to the rack teeth 170 as shown in FIG. 6 during vertical movement of the connector 68 by the associated hydraulic feed cylinder 66*e*.

Figure 6:
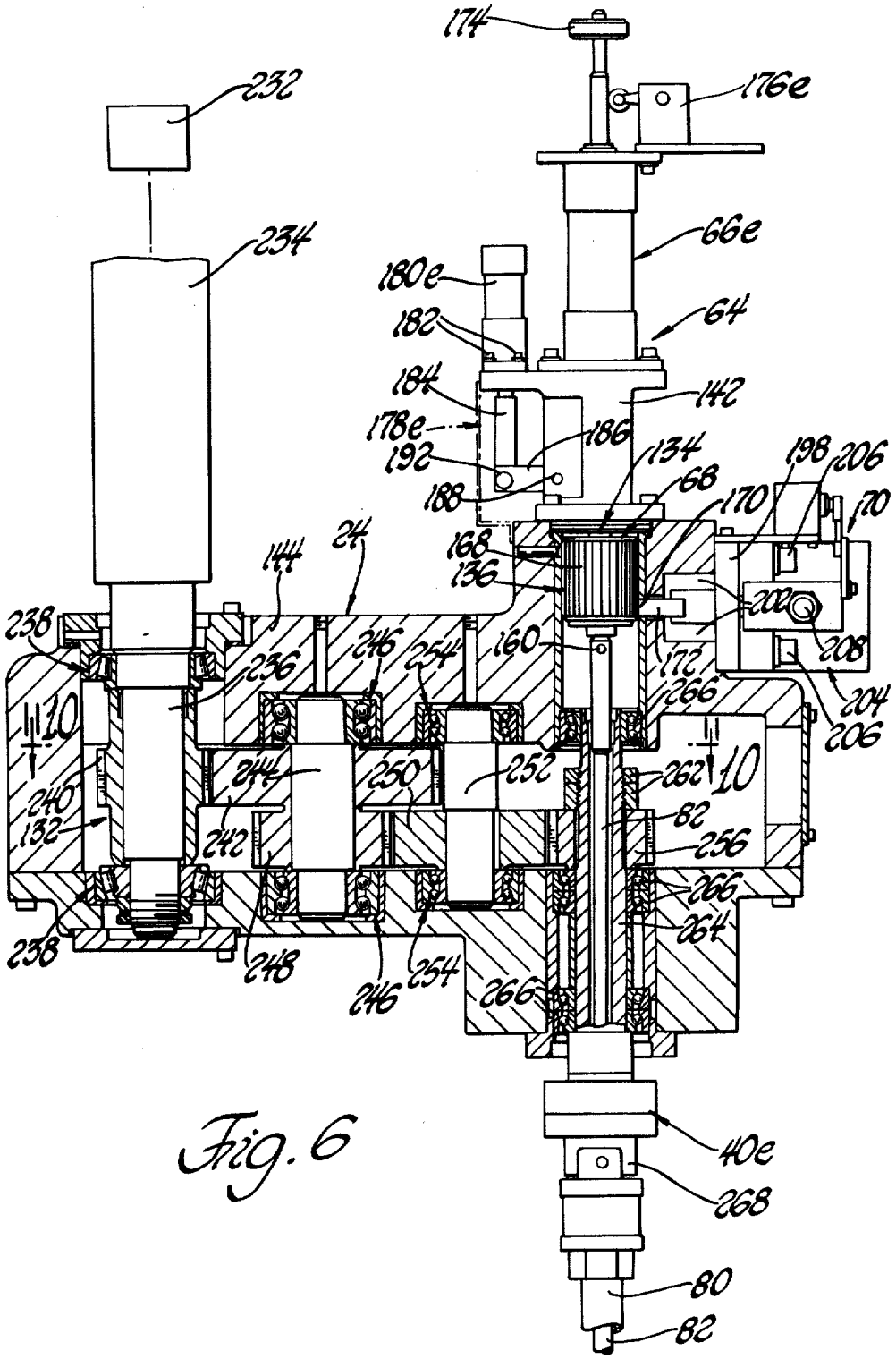
FIG. 6 is a sectional view of the honing machine taken along line 6—6 of FIG. 2*b;*

Hydraulic feed cylinders 66*a* through *h* shown in FIGS. 2*a*, *b*, and *c* move the connectors 68, FIGS. 6 and 7, downwardly to cause the initial expansion of the honing tools within their associated bores to be honed in the manner previously described. Each hydraulic feed cylinder is of the double-rod end type. Equal volumes of fluid thus move the piston of each feed cylinder the same extent in both upward and downward directions so as to facilitate control of the extent of piston movement. Upper ends of the piston rods include wear actuators 174 which move downwardly toward the switch arms of wear switches such as the switch 176*e* shown in FIG. 6 as the honing tools are initially expanded. As the stones 86 of the tool wear, a greater extent of cylinder movement takes place and the switches are tripped when this wear is great enough to require stone replacement. Wear actuators 174 and switches 176*a* through *h* thus cooperate to provide stone wear sensors. Operation of the wear switches as part of the electrical control circuit 74 shown in FIGS. 12*a* and *b* will be more fully hereinafter described.

Each feed cylinder 66*a* through *h* has an associated mechanical lock such as the lock 178*d* shown in FIG. 7. A hydraulic lock actuator or cylinder 180*d* of the lock 178*d* is mounted on the housing portion 142 and secured by bolts 182 and has a downwardly extending piston connecting rod 184 that operates a lock member 186 of the lock. A pin 188 on the housing portion 142 provides a pivotal support for the intermediate portion of the lock member 186 which extends into housing portion 142 through an opening 189. A first end 190 of the lock member has a curved surface or cam lock located on one side of the pin 188 and functions to lock the associated connector 68 against vertical movement upon counterclockwise lock member movement. A second connection end of the lock member 186 includes a pin and slot connection 192 to the cylinder connecting rod 184 such that cylinder piston movement rotates the lock member. Retraction of the lock cylinder 180*d* in a time delayed manner after the initial honing tool expansion by the associated feed cylinder 66*d* pulls the piston connecting rod 184 upwardly to rotate the lock member 186 counterclockwise about pin 188 to a locking position. This rotation cams the lock member end 190 against one side of an axial force isolator 194 whose upper end is mounted on the housing portion 142 by a pin 196. The other side of the force isolator 194 is engaged with the mounting portion 140 of the connector member 134 such that the counterclockwise movement of the lock member 186 to the locking position clamps the member 134 against vertical movement. All of the pressure feed cylinders 66*a* through *h* shown in FIGS. 2*a, b,* and *c* are simultaneously locked against moving their associated connectors 68 (FIGS. 6 and 7) vertically at the same time by simultaneous actuation of the mechanical locks 178*a* through *h* as is more fully described later.

Figure 8:
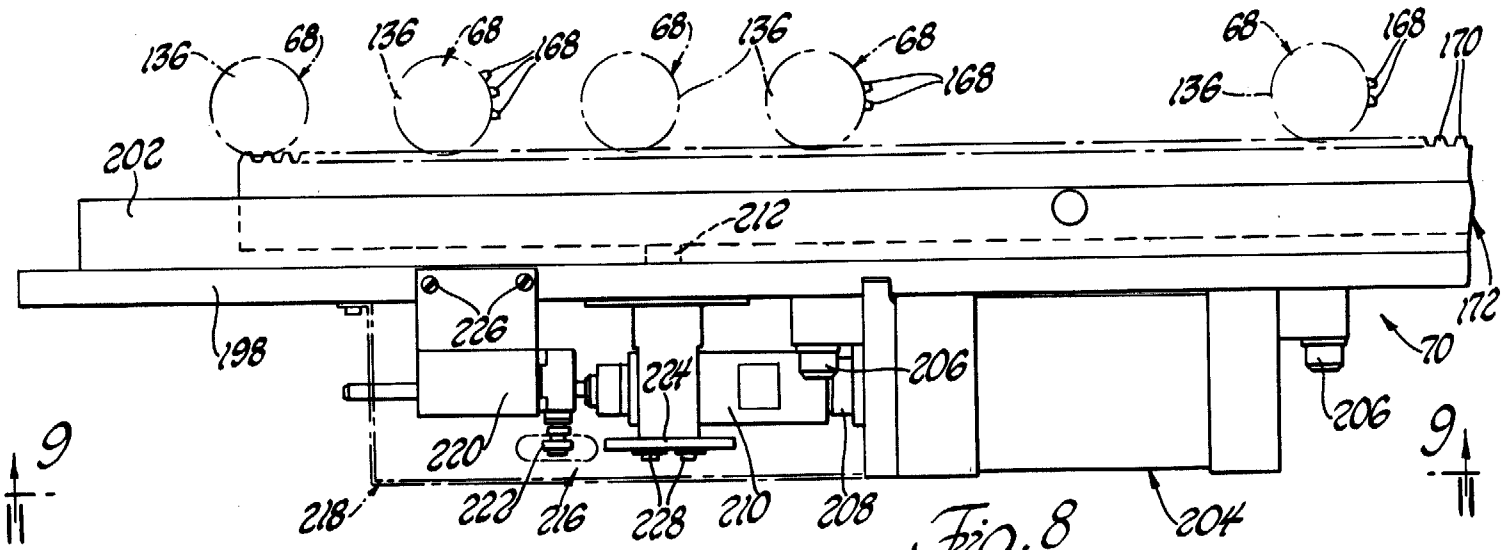
FIG. 8 is a top plan view of a constant rate feed mechanism of the honing machine and is taken generally along line 8—8 of FIGS. 2*a*, *b*, and *c;*
Figure 9:
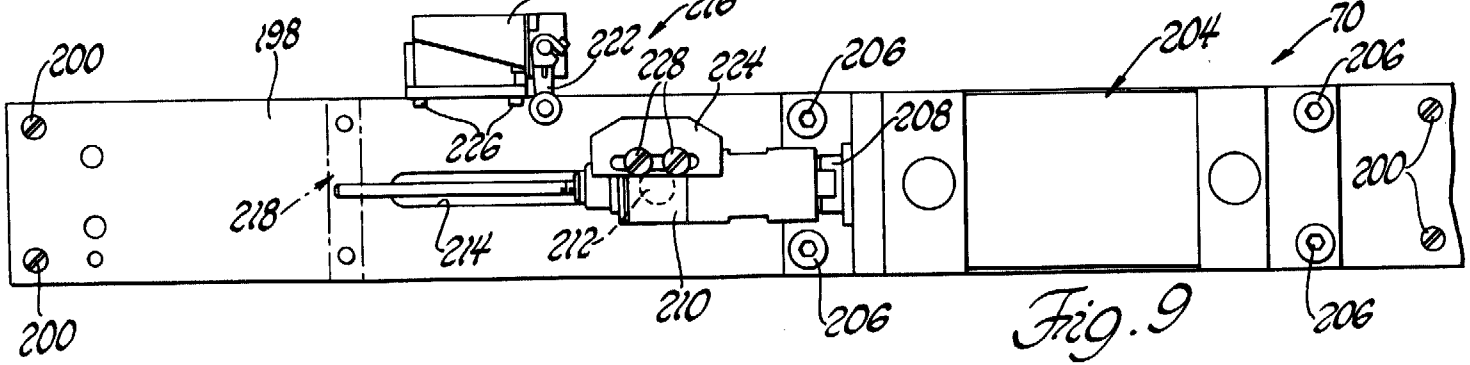
FIG. 9 is a front view of the constant rate feed mechanism taken along line 9—9 of FIG. 8.

Concomitant with the locking of the connectors 68 as described previously with regard to FIG. 7, the constant rate feed mechanism 70 shown in FIGS. 8 and 9 begins to operate to move the gear rack 172 so as to rotate the second threaded member 136 of each connector by the meshing engagement of the gear teeth 168 and the rack teeth 170. Rotation of each member 136 unthreads its insert 150 (FIG. 7) from the lower threaded end 148 of the locked connector member 134 such that the connector rod 82 moves downwardly to expand the stones of the associated honing tool. The rate at which the rod 82 is moved is relatively slow but the impetus for moving the rod is very great due to the large mechanical advantage provided by the unthreading at the connection 138.

Constant rate feed mechanism 70 shown in FIGS. 8 and 9 includes an elongated mounting plate 198 that is secured to the spindle housing by a plurality of bolts 200. Upper and lower slideway members 202 (FIG. 6) are secured to the plate 198 and receive the gear rack 172 therebetween in a slidably mounted relationship. A rack actuator of the constant rate feed mechanism is embodied by a hydraulic operating cylinder 204 that is secured to the mounting plate by bolts 206. Cylinder 204 includes a piston connecting rod whose outer end 208 includes a coupling 210 having a coupling portion 212 that extends through an elongated slot 214 in the plate 198 and is secured to rack 172. Extension of the cylinder rod 208 thus moves the gear rack 172 which in turn rotates the connector members 136 in order to continue the expansion of the honing tools in the manner previously described.

Feed mechanism 70 shown in FIGS. 8 and 9 includes a rack movement sensor 216 mounted within a sheet metal housing 218. Sensor 216 includes a switch 220 whose switch arm 222 is tripped by a switch actuator 224 mounted on the coupling 210 so as to indicate a predetermined amount of rack movement and a corresponding amount of tool expansion indicative of the size to which the bores have been machined. Switch 220 then through the electrical and hydraulic circuits which are described later switches the operating cylinder 204 from a coarse feed rate to a fine feed rate for a final extent of honing near the end of the cycle. It will be noted that the switch 220 is fixedly mounted by bolts 226 on the plate 198 while the switch actuator 224 is mounted by an adjustable bolt and slot connection 228 on the coupling 210. Switch actuator 224 can be moved to the right or the left in order to control the position at which the switch arm 222 is tripped to switch from the coarse to the fine feed rate.

Figure 10:
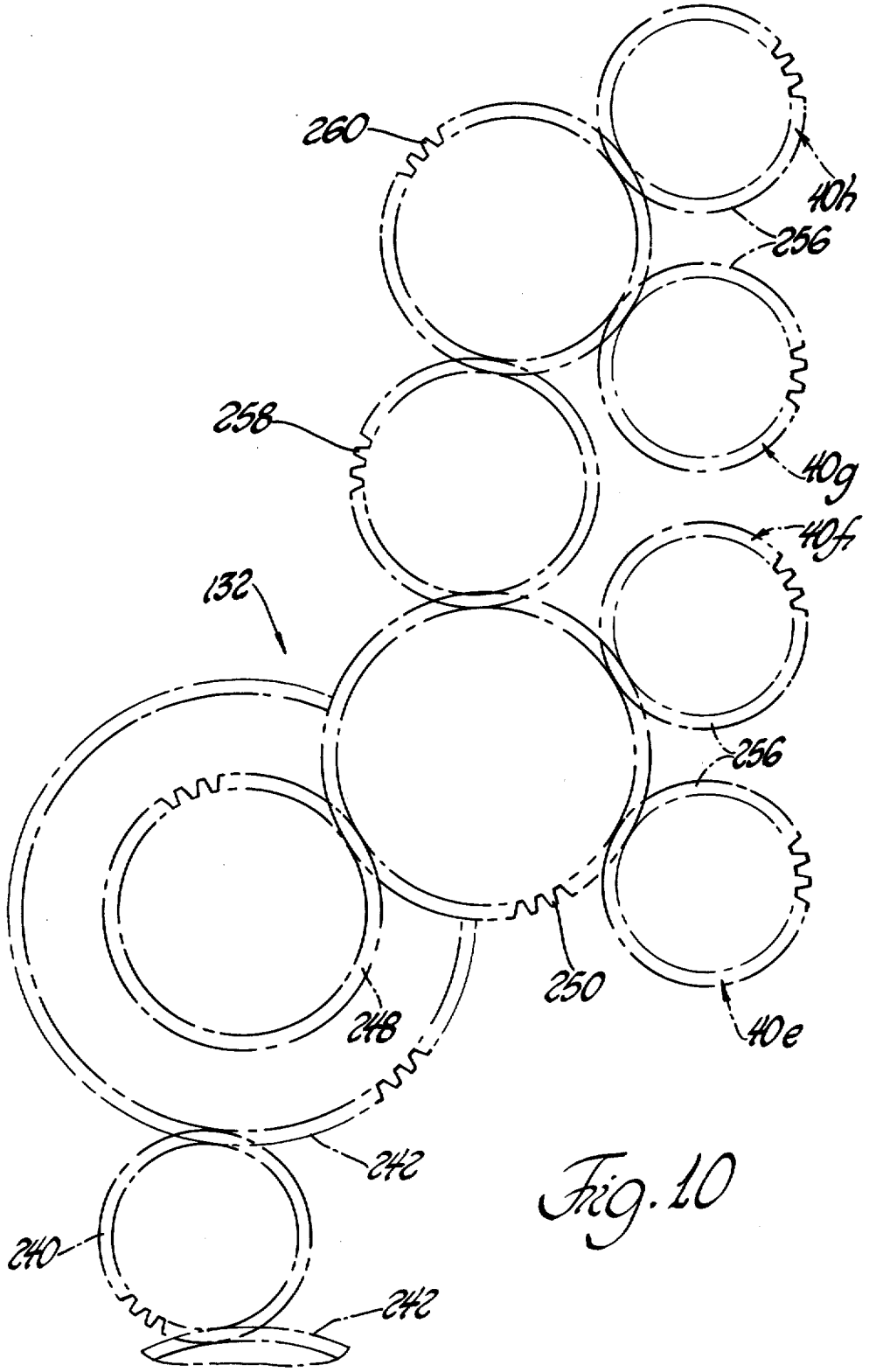
FIG. 10 is a half-sectional view of a gear drive train of the machine taken through a reciprocal spindle head thereof along line 10—10 of FIG. 6.

Each of the spindles 40*a* through *h* shown in FIGS. 2*a, b,* and *c* is rotatably driven by the gear drive train 132 shown in FIGS. 6 and 10. An electrical motor 232 (FIG. 6) on the machine base rotatably drives a ball spline 234 so as to transfer rotary motion to the gear train which is mounted within the housing 144 of the spindle head. Ball spline 234 includes an output shaft 236 that is rotatably mounted by tapered roller bearings 238 on the spindle head housing 144. A gear 240 splined to the shaft 236 drives two gear sets like the one gear set shown in FIG. 10 and each gear set drives four of the spindles 40*a* through *h*. Each gear set includes a large gear 242 meshed with the smaller gear 240 and rotatably supported by a shaft 244 whose ends are mounted on the spindle head housing by antifriction bearings 246. A smaller gear 248 is also supported on the shaft 244 and is driven by the gear 242 in meshing relationship with a gear 250 that is splined on a shaft 252 whose ends are supported on the spindle head housing by bearings 254. Gear 250 is meshed with two drive gears 256 of spindles 40*e* and *f* as shown in FIG. 10 and is also meshed with an idler gear 258. Idler gear 258 drives a gear 260 which in turn drives two drive gears 256 of the spindles 40*g* and *h*. Each of the gears 256 is splined and fixed by nuts 262 shown in FIG. 6 to the upper end of a spindle drive member 264. Antifriction bearings 266 rotatably support the drive member 264 on the spindle head housing with the rod 82 of the associated connector 68 extending downwardly to the honing tool in order to control its expanded or contracted condition. The lower end of the drive member 264 drives a universal coupling 268 which in turn drives the rotary drive member 80 that rotates the honing tool during operation.

It should be noted that while the honing machine herein disclosed includes eight spindles and is particularly adaptable for use in honing V-8 engine blocks, it is also possible to have any other number of multiple spindles for performing honing by the dual feed apparatus of this invention.

Hydraulic control circuit 72 shown in FIGS. 11*a* through *e* controls the operation of the honing machine in a manner which will now be described. Circuitry in the FIGS. 11*a* and *b* controls reciprocal driving movement of the spindle head 24 by the drive cylinders 28 in cooperation with circuitry of FIGS. 11*c, d,* and *e* which controls operation of the pressure feed cylinders 66*a* through *h* and the associated mechanical locks 18*a* through *h* of the pressure feed as well as controlling operation of the drive cylinder 204 of the constant rate feed mechanism. Operation of the electrical solenoids shown in hydraulic circuitry will be described later in connection with FIGS. 12*a* and *b*.

Figure 11A:
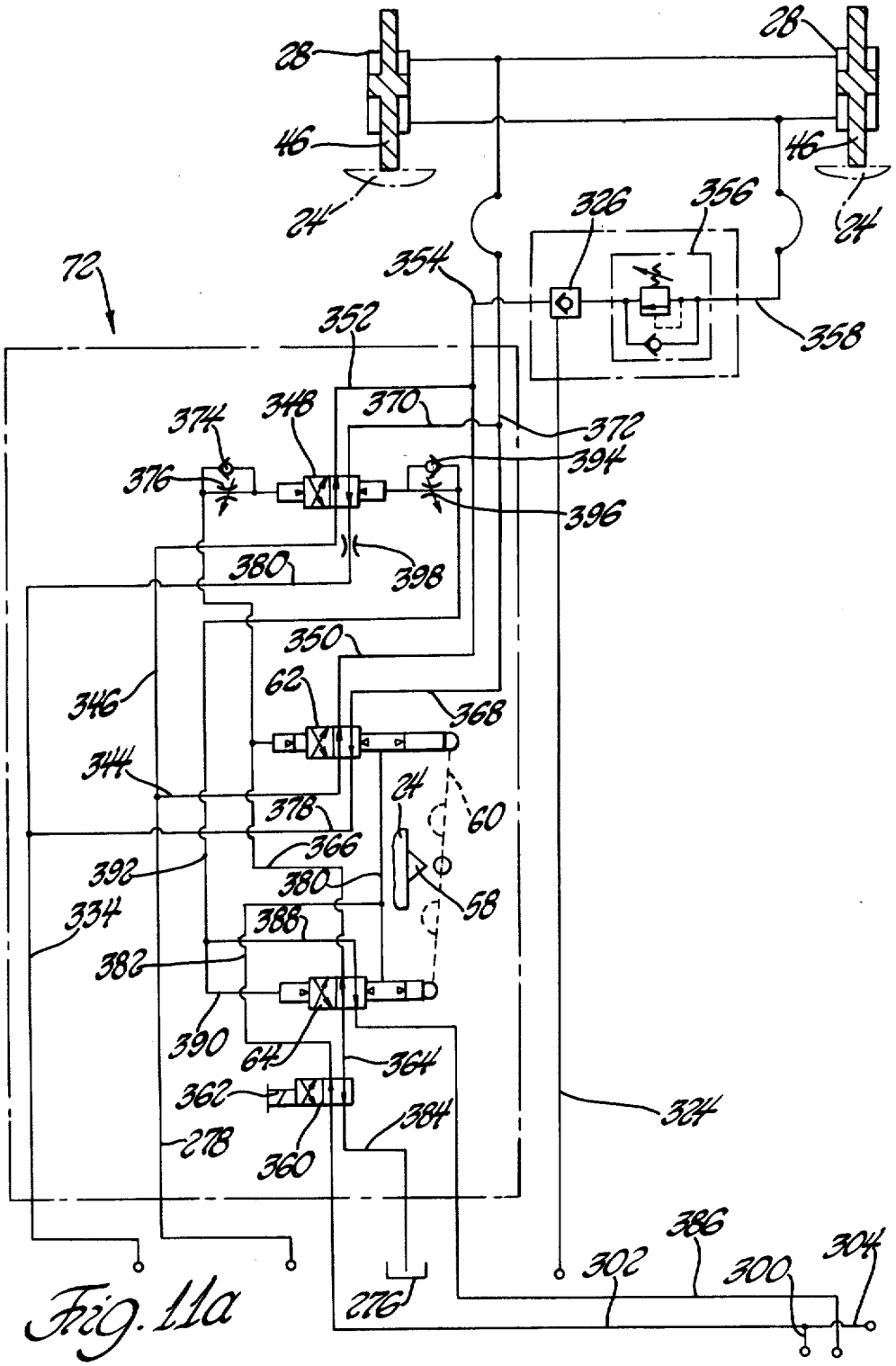
FIGS. 11*a*, 11*b*, 11*c*, 11*d*, and 11*e*, when placed together as shown in FIG. 11*f*, collectively illustrate a hydraulic control circuit of the honing machine.
Figure 11B:
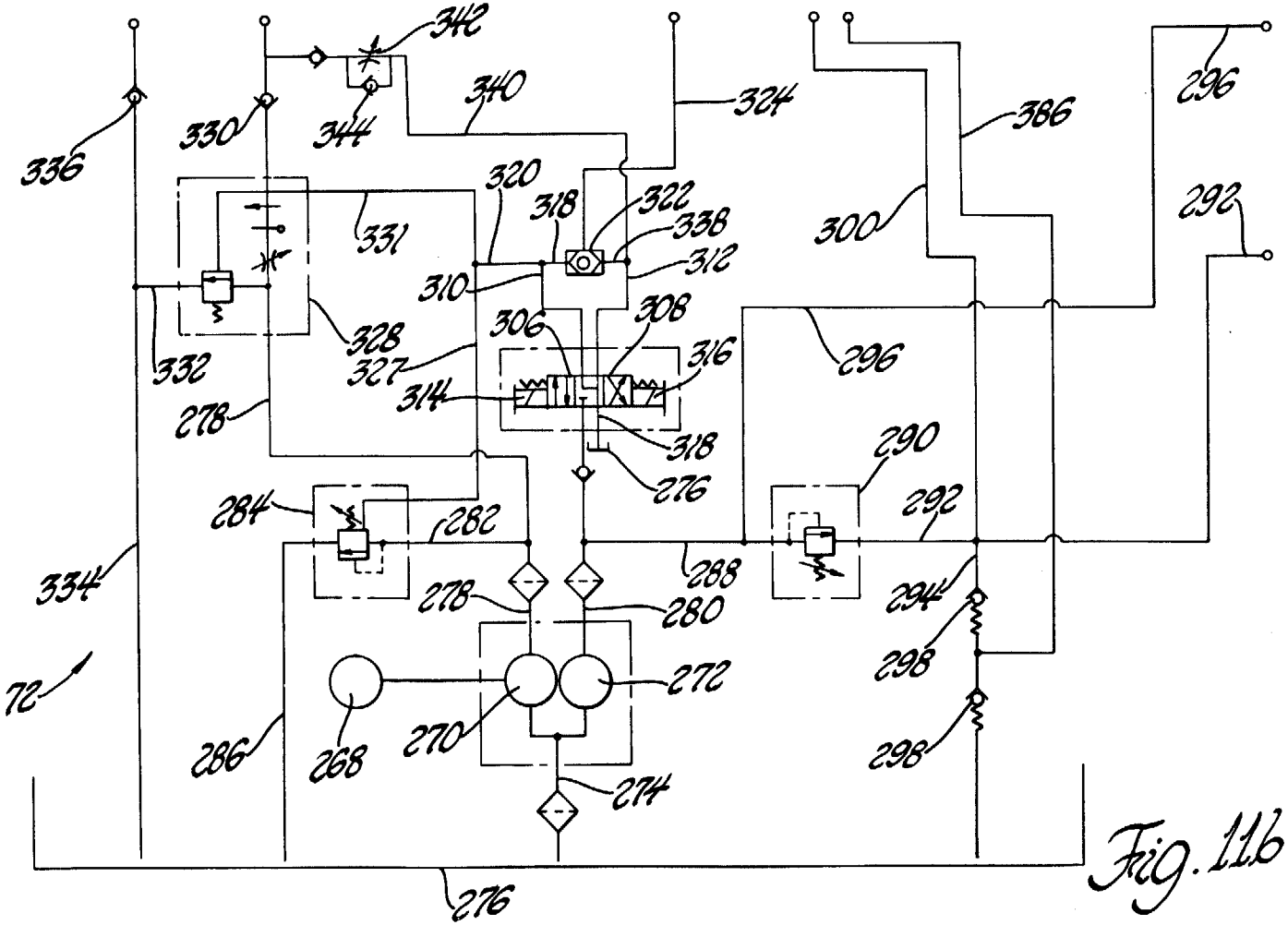

An electric motor 268 shown in FIG. 11*b* drives large and small output pumps 270 and 272, respectively, that draw hydraulic fluid through a common conduit 274 from a reservoir 276. An output conduit 278 of pump 270 supplies hydraulic fluid for operating the spindle head drive cylinders 28 (FIG. 11*a*) while an output conduit 280 of pump 272 supplies hydraulic fluid for controlling the expansion and contraction of the honing tools by both the pressure feed cylinders 66*a* through *h* (FIGS. 11*c* and *d*) and the gear rack operating cylinder 204 (FIG. 11*e*) of the constant rate feed mechanism. Conduit 280 also supplies hydraulic fluid for operating the spindle head drive cylinders slowly during setup operations in a manner which is hereinafter described.

Pump output conduit 278 in FIG. 11*b* feeds a branch conduit 282 which feeds an adjustable relief valve 284. Prior to commencement of a honing cycle, the relief valve 284 dumps hydraulic fluid through a conduit 286 back into the reservoir 276. Relief valve 284 is blocked upon commencement of a machining cycle in a manner which is hereinafter described, so as to maintain the pressure in line 282 below a predetermined value such as 700 psi. Fluid is dumped through the conduit 286 into the reservoir in order to prevent higher pressures. Output conduit 280 from pump 272 feeds a branch conduit 288 that is connected to an adjustable relief valve 290. A conduit 292 connected to the relief valve 290 and a conduit 294 connected to conduit 292 dump hydraulic fluid from this relief valve back into the reservoir 276 in order to prevent the pressure in conduit 288 from building up beyond a predetermined value such as 500 psi. Hydraulic fluid which is fed by a conduit 296 to the control circuitry in FIG. 11*e* from the conduit 288 thus has a predetermined value. Pressure type check valves 298 disposed along the conduit 294 maintain a predetermined level of pressurized fluid in the conduit 292. For example, each of the valves 298 has a pressure setting of 65 psi such that the conduit 292, which communicates with the operating cylinder 204 of the constant rate feed mechanism as shown in FIG. 11*e* carries fluid having a pressure of 130 psi. Likewise, a branch conduit 300, which is connected to a pilot pressure conduit 302 for operating the stroking circuitry in FIG. 11*a* and which is also connected to a conduit 304 that is connected with the control circuitry in FIGS. 11*c, d,* and *e,* has a predetermined level of pressurized fluid under the control of the valves 298.

A start-stop valve 306 and a setup valve 308 shown in FIG. 11*b* control the flow of hydraulic fluid from the conduit 280 to respective conduits 310 and 312. Valve 306 is controlled by a solenoid 314 while valve 308 is controlled by a solenoid 316. Prior to actuation of either solenoid 314 or 316, hydraulic fluid flow through conduit 280 is blocked and the conduits 310 and 312 are connected by conduit 318 to the reservoir 276. Actuation of solenoid 314 shifts the valve element of valve 306 to the right so that the conduit 280 feeds conduit 310 and conduit 312 is connected to the conduit 318 feeding reservoir 276. Hydraulic fluid flowing to conduit 310 is then fed to branch conduits 318 and 320. Branch conduit 318 feeds a shuttle valve 322 so that pressurized fluid is fed through a conduit 324 in order to open a check valve 326 (FIG. 11*a*). Prior to opening of the check valve 326, the hydraulic fluid is locked in the lower side of drive cylinders 28 in order to maintain the spindle head 24 in its upper withdrawn position. Upon opening of check valve 236, hydraulic fluid can flow from the stroking circuitry shown in FIG. 11*a* to the drive cylinders in a manner which will be hereinafter described. Fluid flow to conduit 320 from the conduit 310 is fed through a conduit 327 to the relief valve 284 so as to move its valve element downwardly and thereby terminate the dumping of the fluid flow from pump 270 through this relief valve to the reservoir. Consequently, the hydraulic fluid is fed from the pump 270 through conduit 278 to a constant flow valve 328 that feeds a constant rate of fluid through a check valve 330 to the stroking circuitry shown in FIG. 11*a*. Conduit 320 also feeds a branch conduit 331 that connects to valve 328 to control its operation. Excess fluid is fed from the valve 328 to a conduit 332 that feeds a drain conduit 334 feeding back to the reservoir. A check valve 336 prevents the excess fluid from being fed to the stroking circuitry in FIG. 11*a*.

Valve 308 shown in FIG. 11*b* is actuated by the solenoid 316 to provide relatively slow movement of the spindle head during the initial setup of the honing machine operation. Movement of the valve element of valve 308 to the left connects the output conduit 280 of pump 272 to the conduit 312 and concomitantly connects the conduit 310 to the reservoir conduit 318. Fluid flow to the conduit 312 then feeds a conduit 338 that operates the shuttle valve 322 to feed fluid to the conduit 324 in order to open the check valve 326. Relief valve 284 is then dumping the fluid flow from pump 270 through the conduit 286 to the reservoir 276 and there is thus no fluid flow upwardly through check valve 330 to the stroking circuit in FIG. 11*a*. However, fluid of a lower pressure does flow from the conduit 312 through a conduit 340 to a variable orifice 342 and a check valve 344 to the conduit 278 downstream from its check valve 330 so as to flow to the stroking circuitry in FIG. 11*a*.

Prior to commencement of a stroking cycle, the stroking circuitry is positioned as shown in FIG. 11*a* with hydraulic fluid being fed through the supply conduit 278 to a branch conduit 344 that feeds the valve 62 and through a branch conduit 346 that feeds an anti-stall valve 348. Valve 62 feeds a conduit 350 while valve 348 feeds a conduit 352 whose common junction feeds a conduit 354 leading to the check valve 326 which has been opened by the fluid flow through conduit 324. Check valve 326 feeds a valve 356 which is adjustable to control the pressure of the fluid which is fed through a conduit 358 to the lower sides of the pistons 28′ of the drive cylinders 28 in accordance with the weight of the spindle head 24. Consequently, the fluid flow tends to maintain the spindle head 24 in its withdrawn position until commencement of a honing cycle is actuated.

A control valve 360 shown in FIG. 11*a* is actuated by a solenoid 362 to move its valve element to the right from the position shown in order to feed pilot pressure from the conduit 302 through valve 360 to a conduit 364 which feeds the valve 64. Fluid from the valve 64 is fed through a conduit 366 to valve 62 and to valve 348 in order to move the valve elements thereof to the right. Stroking fluid supplied from the pump output conduit 278 to the branch 344 and to the valve 62 is then switched from the conduit 350 to a conduit 368 and the fluid flow to the branch conduit 346 through valve 348 is likewise switched from the conduit 352 to a conduit 370 which has a common junction with the conduit 368 and feeds a conduit 372 connected to the drive cylinders 28 at the upper sides of their pistons 28′ such that downward driving movement of the spindle head 24 is thereby commenced. It will be noted that the flow of pilot pressure fluid to valve 348 through conduit 366 passes through a check valve 374 which is in parallel with a variably restricted orifice 376 whose cooperable action will be described later. Upon commencement of the downward driving, fluid from the lower sides of the drive cylinder pistons 28′ is fed through the conduit 358 and valves 356 and 326 to the conduit 354 for flow through conduits 350 and 352 to the valves 62 and 348. Fluid from conduit 350 is fed through valve 62 to a conduit 378 while the fluid from conduit 352 is fed through valve 348 to a conduit 380 which has a common junction with conduit 378 for feeding the drain conduit 334.

As the initial downward stroke of the spindle head proceeds, the valve dog 58 shown in FIG. 11*a* on the spindle head 24 moves downwardly prior to actuating counterclockwise rotation of the valve actuator 60. A conduit 380 communicated with the right sides on the valve elements of valves 62 and 64 is communicated with a conduit 382 that is communicated through the valve 360 to a conduit 384 to reservoir 276. A conduit 386 communicated with the conduit 294 between its valves 298 as shown in FIG. 11*b* feeds fluid through the valve 64 to a conduit 388 as the downward stroking proceeds but with a pressure that is less than the pressure of the fluid fed through conduit 302 to the valve 360. Fluid flow from conduit 388 to a conduit 390 biases the valve element of valve 64 to the right but is prevented from so moving this valve element by the valve actuator 60 that is biased by the greater fluid pressure acting on the valve element of valve 62 from conduit 302, through valve 360, conduit 364, valve 64, and conduit 366. Likewise, a conduit 392 feeds pressurized fluid to the right side of the valve element of valve 348 but is prevented from moving this valve toward the left by the greater pressure that is fed through conduit 366. It should be noted that conduit 392 feeds fluid to valve 348 through a check valve 394 and a variably restricted orifice 396 in a similar manner as the valve 374 and the orifice 376 that feed fluid to the other side of the valve 348 for a function which is to be described.

Engagement of the valve dog 58 with the valve actuator 60 at the lower extent of the spindle head stroke cams the valve actuator 60 counterclockwise to move the valve element of valve 62 from the right to the left while the fluid from conduit 386 through valve 64 feeds conduit 388 and branch conduit 390 in order to move the valve element of valve 64 from the left toward the right. Movement of the valve element of valve 62 to the left switches the feed of the stroking fluid from conduit 278 through conduit 344 from conduit 368 to conduit 350 so that the fluid is supplied through conduit 358 to the drive cylinders 28 at the lower sides of their pistons 28' in order to begin an upward movement of the drive cylinders and the connected spindle head 24. Likewise, the fluid from the conduit 372 is then fed through conduit 368 and through valve 62 to the conduit 378 for feeding to the drain conduit 334. Movement of the valve element of valve 64 to the right at the bottom end of the stroke feeds the greater pilot pressure from conduit 302, valve 360, and conduit 364 through valve 64 to conduit 388 and to conduit 390 so as to thereby act on the valve element of 64 and maintaining it at its position to the right. Likewise, the branch conduit 392 feeds the greater pilot pressure to the right side of the valve element 348. Consequently, at the bottom of the stroke, the greater and lesser pilot pressures respectively switch from the left and right side of the valve element of valve 348 to the right and left side thereof. However, the cooperable action of the check valves 374 and 394 and the restricted orifices 376 and 396 prevents this change from taking place instantaneously so that valve 348 continues to supply fluid to the conduit 370 in order to maintain the downward driving of the spindle and the switch actuator dog 58 in order to complete the driving of the valve element of valve 62 to the left as previously described. After a short period of time following the movement of the valve element of valve 62 to it left position, the valve element of valve 348 likewise moves to the left position and also switches the supply of hydraulic fluid from branch conduit 346 to conduit 352 from conduit 370 so as to drive the cylinder pistons 28' upwardly.

Upward driving of the spindle head 24 moves the valve dog 58 upwardly and at the upper extent of the stroke pivots the actuator 60 in a clockwise direction so that the valve 64 is cammed back to the left position shown in FIG. 11*a* and the pilot pressure from conduit 366 through valve 64 then moves the valve element of valve 62 to its right position. Driving fluid from supply conduit 278 fed through valve 62 is then switched from conduit 350 to conduit 368 and conduit 358 then feeds fluid through conduit 350, valve 62, and the branch conduit 378 to the drain conduit 334. High and low pressure pilot fluid from conduits 302 and 386 through valve 64 are respectively switched from the left and right sides of the valve element of valve 348 to the right and left sides thereof by the valve 64 at the upper extent of the spindle head stroke but in a time-delayed manner due to the cooperation of the check valves 374 and 394 and the restricted orifices 376 and 396. This time-delayed switching of the valve 348 insures a complete movement of the spindle head 24 for camming the valve actuator 60 to complete the movement of valve 64 to its full position toward the left.

It should be noted that the conduit 380 which feeds fluid to the drain conduit 334 at both the upper and lower extends of spindle head movement includes a restricted orifice 398 that functions during the time-delayed switching of the valve element of valve 348 to limit the fluid forced from the drive cylinders 28 by the piston movement in order to cause a deceleration of the spindle head 24. Consequently, the spindle head is not moving at full speed when it begins its reverse movement at both the upper and lower ends of the stroke.

After completion of a honing cycle, the solenoid 362 is deactuated so that the valve element of valve 360 is moved from the right toward the left so that the greater pilot pressure through conduit 382 is fed through valve 360 and conduit 382 to the conduit 380 and to the right sides of the valve elements of valves 62 and 64. Both of the valves 62 and 64 are then positioned as shown so that the fluid supplied through conduit 278 drives the spindle head 24 upwardly all the way to its upper withdrawn position.

Operation of the pressure feed cylinders 66*a* through *h* and the constant feed mechanism 70 shown in FIGS. 11*c, d,* and *e* will now be described. In connection with this description it should be remembered that the conduits 292 and 304 supply low pressure hydraulic fluid to this circuitry while the conduit 296 supplies high pressure hydraulic fluid. As shown, the feed cylinders 66*a* through *h* are positioned so as to maintain their associated honing tools contracted while the drive cylinder 204 of the constant rate feed mechanism is located in a retracted position corresponding to the withdrawn position of the spindle head as previously described in connection with the stroking circuitry shown in FIGS. 11*a* and *b*. In this condition, conduit 296 feeds a branch conduit 400 which in turn feeds an adjustable expand pressure valve 402 connected to a conduit 404 which feeds a run-out pressure valve 406 that is operated by a solenoid 408. Valve 406 feeds a conduit 410 which supplies the high pressure hydraulic fluid to branch conduits 412 respectively associated with the expand cylinders 66*a* through *h*. Branch conduits 412 selectively feed respective conduits 413 through associated cylinder feed valves 414*a* through *h* operated by solenoids 416*a* through *h*. Conduits 413 have restricted orifices 418 that limit the fluid flow rate through conduits 412 in order to control the rate at which tool expansion and contraction takes place. Solenoids 416*a* through *h* are unactuated as shown such that the expand valves 414*a* through *h* have their valve elements at the left position shown so as to supply the high pressure hydraulic fluid from conduit 410 through conduits 412 and 413 to the lower sides of the feed cylinder pistons 66*a'* through *h'* in order to maintain the honing tools in a contracted condition. Upper sides of the feed cylinder pistons 66*a'* through *h'* are respectively communicated by branch conduits 420 through the valves 414*a* through *h* and conduits 421 with conduits 422 that are pressurized with low pressure hydraulic fluid from the conduit 304 as previously mentioned.

Conduit 304 (FIG. 11*e*) also supplies a conduit 424 which feeds a master lock valve 426 operated by a solenoid 428. A branch conduit 430 connected with the high pressure fluid conduit 296 likewise feeds the valve 426. Solenoid 428 is unactuated as shown so that the valve 426 supplies low pressure hydraulic fluid from conduit 424 to a conduit 432 which feeds the low pressure hydraulic fluid to branch conduits 434 respectively associated with the lock cylinders 180*a* through *h*. Conduits 434 are connected with associated lock valves 436 that are controlled by fluid pressure supplied through conduits 438 which tap off of the conduits 420 connected to the upper sides of the feed cylinder pistons 66*a'* through *h'*. In the retracted tool position shown, conduits 420 communicates low pressure fluid such that the valve elements of valves 436 are positioned to the left by their spring bias and thereby communicate the conduits 434 with conduits 438 connected to the upper sides of the pistons of lock cylinders 180*a* through *h* as well as communicating conduits 442 connected to the lower sides of the lock cylinder pistons with conduits 444 that are connected to the low pressure conduit 422. Both the upper and lower sides of the lock cylinder pistons 180*a'* through *h'* are then communicated with low pressure fluid and the larger cross-sectional area of the upper sides thereof thus applies a downward force to the pistons in order to prevent upward piston movement that initiates locking of the mechanical locks in the manner previously described.

The initial honing tool expansion by the feed cylinders 66*a* through *h* takes place when the solenoids 416*a* through *h* shown in FIGS. 11*c* and *d* are actuated at the bottom of the first spindle head stroke in a manner that will subsequently be described in connection with the electrical circuit. This solenoid actuation moves the valve elements of valves 414*a* through *h* to the right and thereby communicates the high pressure branch conduits 412 with the conduits 420 that are communicated with the upper sides of the feed cylinder pistons 66*a'* through *h'*. At the same time, the conduits 413 connected to the lower sides of the feed cylinder pistons 66*a'* through *h'* are communicated with the conduits 421 connected to the low pressure conduit 422. The net result is that the high pressure on the upper sides of pistons 66*a'* through *h'* and the low pressure on the bottom sides thereof causes a downward piston movement that expands the tools 42*a* through *h* so that the tool stones are contacted with the bores in which the tools are inserted. It will be recalled that this piston movement is limited by the cooperation of the switch actuators 174 and the switches 176*a* through *h* that terminate machine operation if the tool stones are worn and require replacement. High fluid pressure supplied to the conduit 422 in order to expand the honing tools also is fed through the conduits 438 to the valves 436 in order to move the valve elements thereof to the right and communicate conduits 434 with their associated conduits 442 as well as communicating the conduits 440 with their associated conduits 444. Both of the conduits 422 and 432 that are respectively connected to the conduits 444 and 434 are still at low pressure at this time so that the lock cylinders 180*a* through *h* do not operate to initiate locking of the mechanical locks.

Figure 11C:
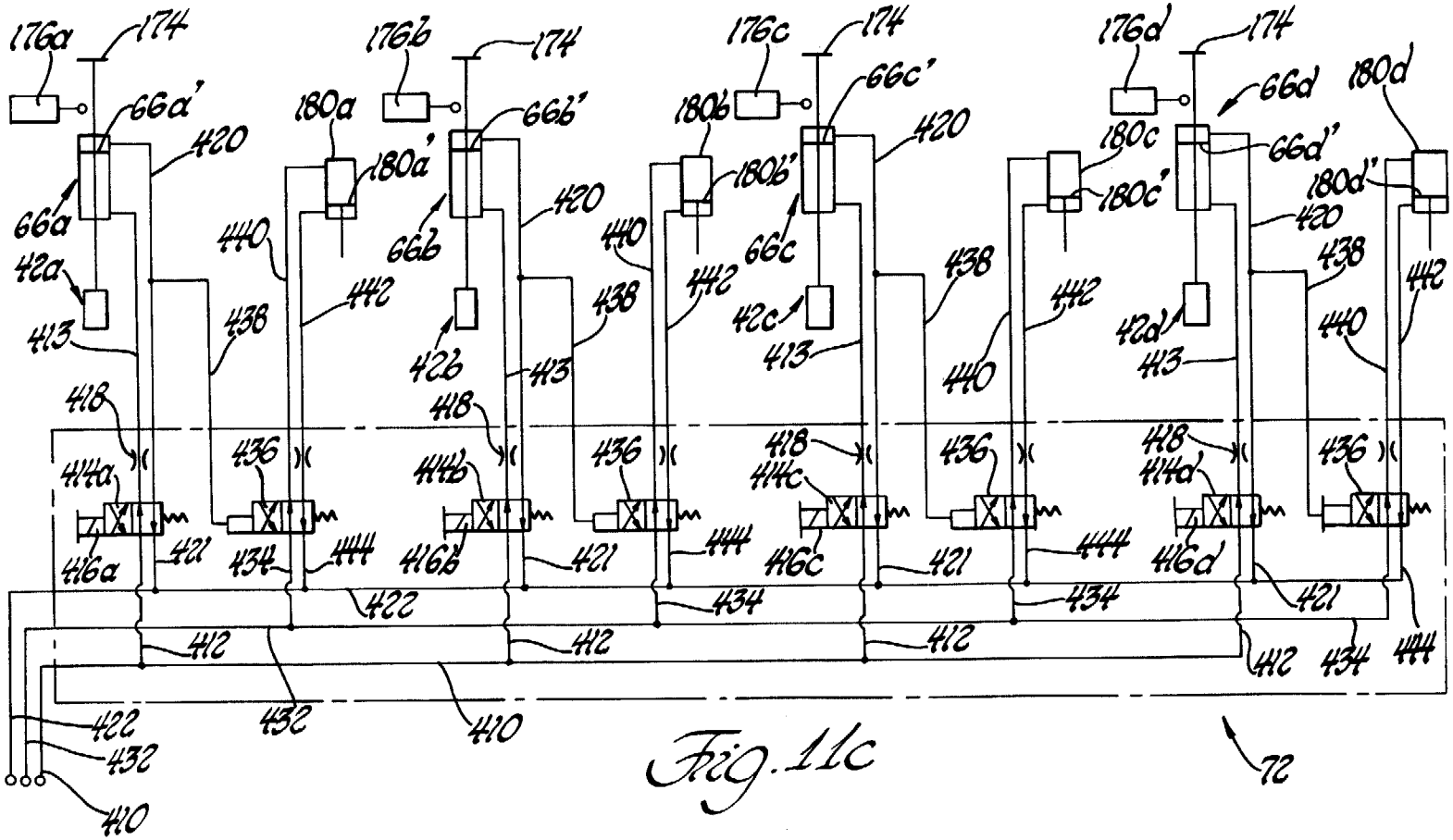
Figure 11D:
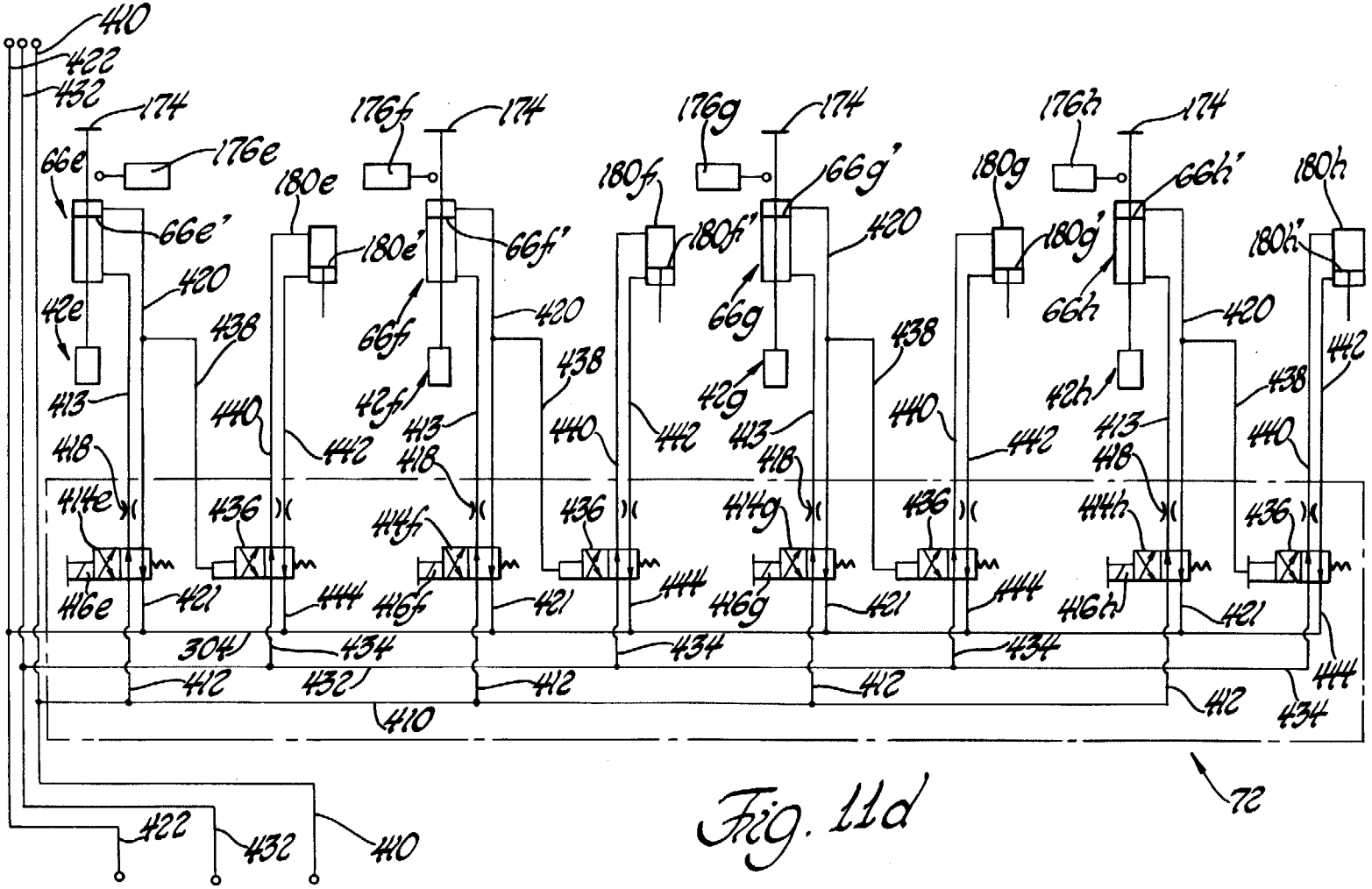
Figure 11E:
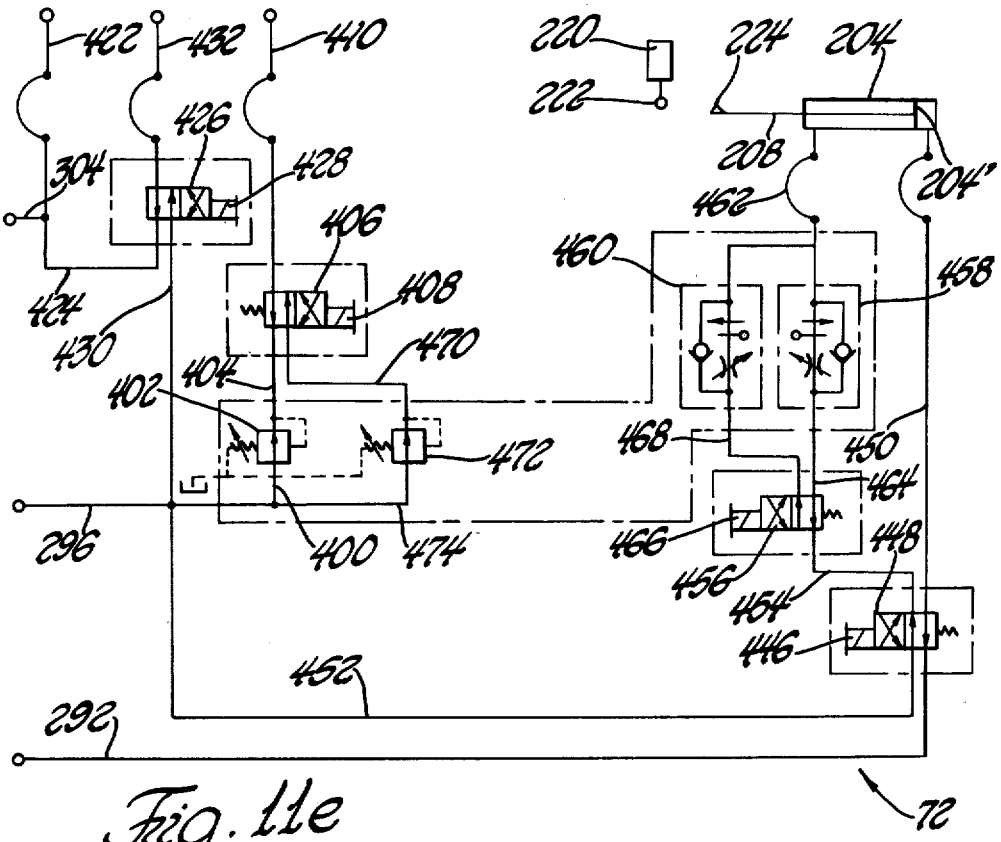
Figure 11F:
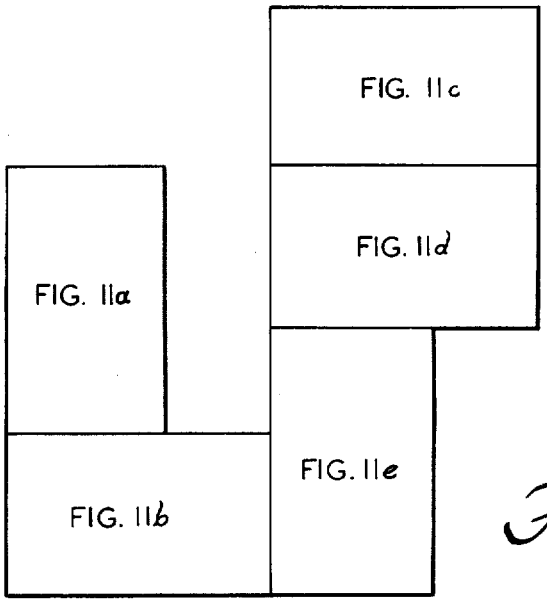

Locking operation of lock cylinders 180*a* through *h* shown in FIGS. 11*c* and *d* and operation of the operating cylinder 204 of the constant rate feed mechanism shown in FIG. 11*e* are initiated after the feed cylinders 66*a* through *h* have expanded the honing tools for a predetermined period of time, normally on the order of several seconds. At the end of this time period, the solenoid 428 is actuated in a time-delayed manner by the electrical circuit 74 which will subsequently be described and thereby moves the valve element of master lock valve 426 to the left so that the high pressure fluid from the branch conduit 430 is supplied to the conduit 432. This high pressure fluid is then fed to the conduits 434 through the valves 436 to the conduits 442 that connect to the lower sides of the lock cylinder pistons 180*a'* through *h'*. Upward piston movement is then initiated so as to actuate the locking of the mechanical locks in the manner which was previously described. This locking action prevents the connectors 68 previously described in connection with FIGS. 6 and 7 from applying an expanding force to their associated honing tools under the impetus of downward piston force that remains applied on the feed cylinder pistons 66*a'* through *h'*.

Actuation of the solenoid 428 shown in FIG. 11*e* and locking of the feed cylinders is accompanied by a simultaneous actuation of a solenoid 446 that operates a rack cylinder supply valve 448 of the constant rate feed mechanism. Prior to this actuation, the valve 448 connects the low pressure fluid conduit 292 with a conduit 450 connected to the cylinder 204 at the right side of its piston 204'. Likewise, prior to the actuation of solenoid 446, valve 448 connects a branch conduit 452 from the high pressure fluid conduit 296 with a conduit 454 that feeds through a rate feed valve 456 and a coarse rate feed valve path 458 that is in parallel relationship with a fine rate feed valve path 460 to a conduit 462 connected to the rack drive cylinder 204 at the left side of its piston 204'. Higher pressure on the left side of the piston 204' thus maintains the piston against extending movement of its connecting rod 208 and consequent driving of the actuating rack that unthreads the connectors 68 shown in FIGS. 6 and 7 in the manner previously described.

Upon actuation of the solenoid 446 in FIG. 11*e*, the valve element of valve 448 is shifted to the right and connects the high pressure conduit 452 with the conduit 450 that feeds to the right side of the rack cylinder piston 204' and at the same time connects the lower pressure conduit 292 with the conduit 454 that is connected to the left side of the rack cylinder piston 204'. Piston 204' is then driven toward the left at a constant rate to unthread the connectors 68 in the manner previously described. Coarse rate feed valve path 458 then controls the fluid flow rate from conduit 462 to a conduit 464 and through valve 456 to the conduit 454 that is connected through valve 448 to the low pressure conduit 292 for dumping to the reservoir. After a predetermined extent of the piston travel, actuator 224 trips the arm 222 of switch 220 in order to actuate a solenoid 466 associated with the feed valve 456. Valve 456 then shifts to the right and thereby communicates a conduit 468 with the conduit 454 so that the fluid flow from the rack operating cylinder is delivered through conduit 462 to the fine flow feed valve path 460. Valve path 460 allows a lower flow rate of fluid therethrough and the net result is that the piston 204' is driven at a slower rate during the final portion of the honing cycle so as to provide a slower material removal rate and a consequent smoother surface finish.

Each solenoid 416*a* through h is deactuated independently of each other when the bore being honed thereby reaches the required size. For example, tripping of switch 130*a* shown in FIG. 3 when the bore being honed by tool 42*a* reaches the final size deactuates the associated solenoid 416*a* independently of the other solenoids. The valve element of valve 414*a* is then shifted to the left so that the high pressure fluid from conduit 410 is fed through the associated branch conduit 412 through valve 414*a* and conduit 413 to the lower side of the feed cylinder piston 66*a*'. At the same time, the low pressure conduit 422 is communicated with the conduit 421 that is connected through valve 414*a* to the conduit 420 connected to the upper side of piston 66*a*'. The switch from high to low pressure in conduit 420 also causes a similar pressure change in the conduit 438 that controls the associated lock valve 436 whose valve element concomitantly shifts to the left. Conduits 434 and 440 then feed low pressure fluid from the conduit 432 through valve 436 to the upper side of the lock cylinder piston 180*a*' while the conduits 444 and 442 likewise supply low pressure fluid through valve 436 to the lower side of the same piston. The greater cross-sectional area of the upper side of lock piston 180*a*' then drives this piston downwardly to initiate unlocking of the associated mechanical lock so that the piston feed cylinder 66*a*' can be driven upwardly by the greater fluid pressure applied to its lower side as compared to its upper side. The honing tool 42*a* is thus contracted independently of each other honing tool. It will be noted that the second threaded gear member 136 (FIG. 7) of each connector 68 continues to be rotated by the drive rack 172 of the constant rate feed mechanism even though the associated honing tool is contracted but the unthreading of the threaded connection 138 does not then produce tool expansion because the first threaded member 136 is free to move upwardly under the upward bias of the associated feed cylinder piston.

After all of the bores being honed have reached size and their associated honing tools have been contracted as described above, the solenoid 408 shown in FIG. 11*e* is actuated for a predetermined period of time together with all of the solenoids 416*a* through *h*. Actuation of the solenoid 408 shifts the valve 406 to the left so as to communicate the conduit 410 with a conduit 470 connected to an adjustable valve 472 which is fed by a conduit 474 from the high pressure fluid conduit 296. A selected pressure is thus fed to conduit 410 and through the branch conduits 412 through the valves 416*a* through *h* to their associated conduits 420 so as to bias the feed cylinder pistons 66*a*' through *h*' downwardly in order to expand the honing tools and perform a finish honing of all of the bores at the same time. Deactuation of all of the solenoids 416*a* through *h* takes place at the same time and is accompanied by deactuation of the solenoid 408 so that the conduit 410 supplies high pressure fluid to the conduit 432 and to the branch conduits 412 that feed through the valves 414*a* through *h* to conduits 413 in order to move the feed cylinder pistons 66*a*' through *h*' upwardly and thereby contract the honing tools. Concomitantly, the solenoid 362 in FIG. 11*a* is deactuated so that the reciprocation of the spindle head 24 is terminated and the spindle head is driven upwardly to its withdrawn position so that the honing tools are pulled from the bores whose honing has then been completed.

Operation of the electrical circuit will now be described in connection with FIGS. 12*a* and *b*. A source of power 476 of the system is connected across the wear indicating switches 176*a* through *h* to the other circuitry such that opening of any one of the switches when the associated honing tool stones have become worn and require replacement terminates the machine operation. A switch 478 is closed to energize the motor 268 that drives the pumps 270 and 272 as previously described in connection with FIG. 11*b*. Another switch 480 is selectively closed to energize the solenoid 316 that actuates very slow spindle head movement for facilitating the initial setting up of machine operation prior to production. Closing of a switch 482 actuates the solenoid 314 so that the conduit 278 shown in FIGS. 11*a* and *b* supplies fluid to the valves 62 and 348 as previously described. A stroking cycle is actuated by closing a switch 484 that energizes the stroking solenoid 362 so that the stroking circuitry shown in FIG. 11*a* begins the reciprocal stroking movement of the spindle head 24.

Figure 12A:
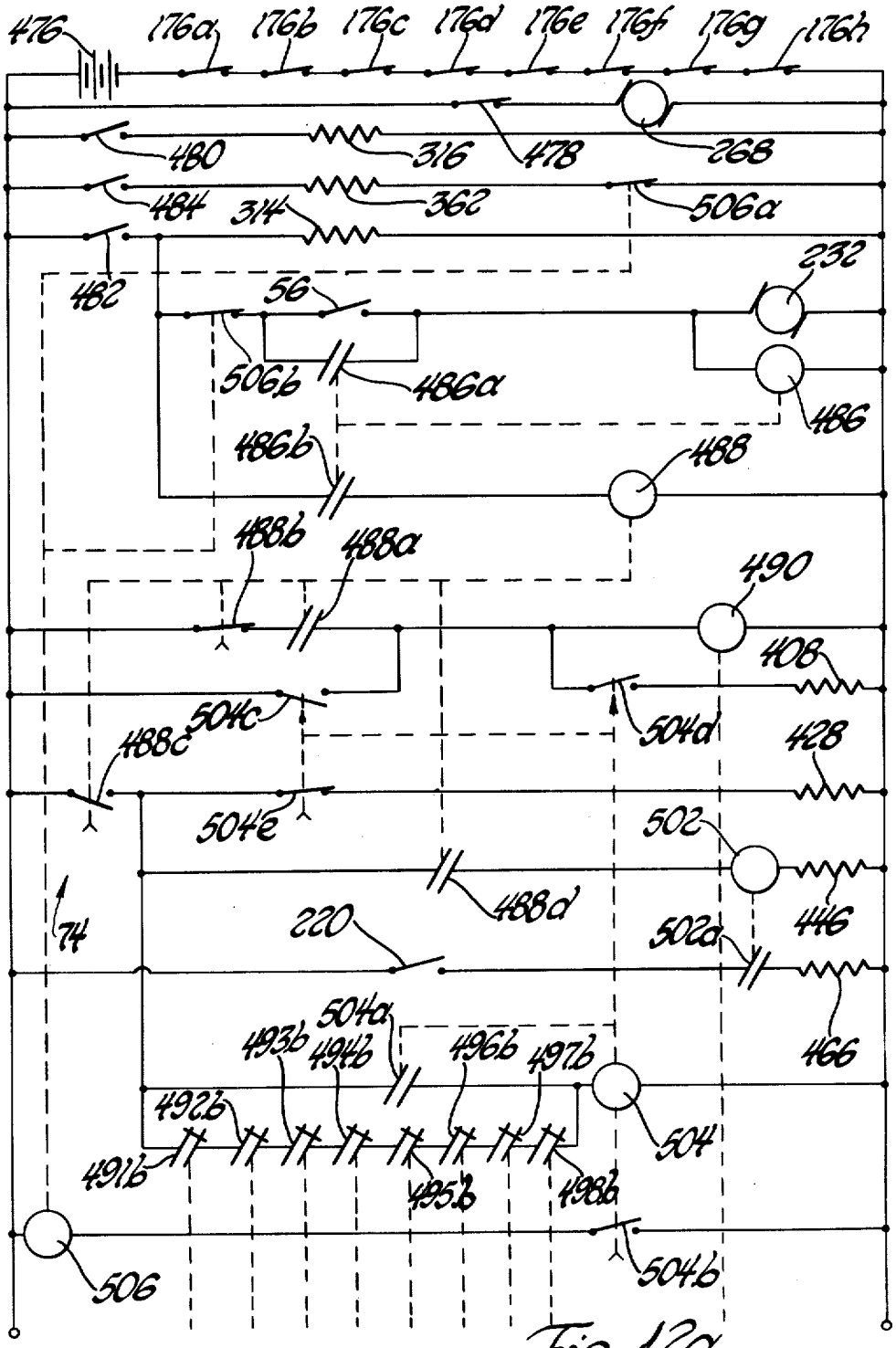
FIGS. 12*a* and 12*b* when placed alphabetically from the top toward the bottom collectively illustrate an electrical control circuit of the machine.
Figure 12B:
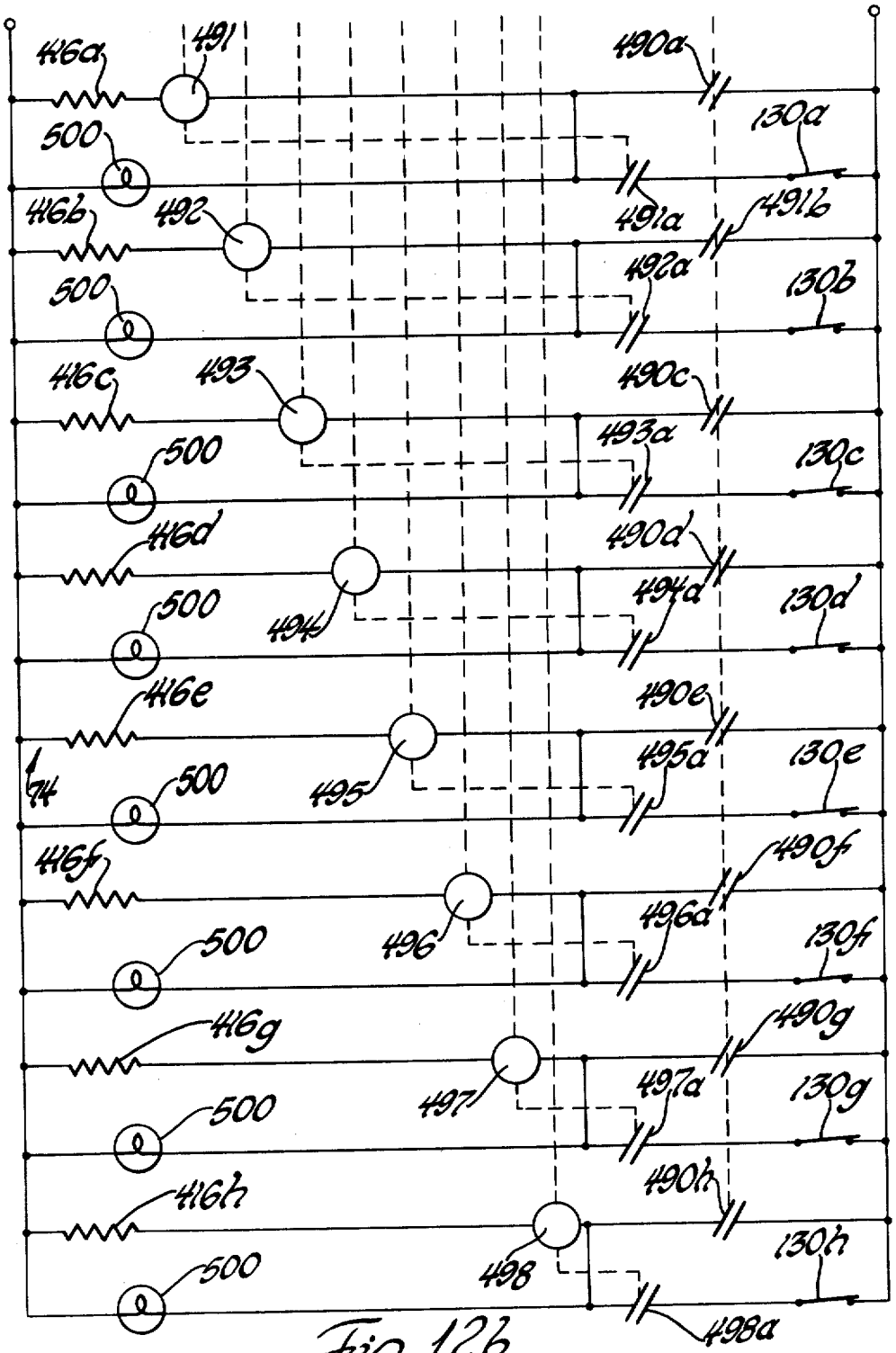

Upon the initial downward stroke of the spindle head 24, the switch 56 shown in FIG. 12*a* is closed as previously described and thereby energizes the spindle drive motor 232 as well as energizing a contact relay 486. Instantaneous contacts 486*a* of relay 486 then close to maintain itself and the spindle motor 232 energized while instantaneous contacts 486*b* of this relay close to energize a timer relay 488. Instantaneous contacts 488*a* of relay 488 energizes a relay 490 through a set of normally closed timer contacts 488*b*. Instantaneous contacts 490*a* through *h* of energized relay 490 are closed to respectively energize the solenoids 416*a* through *h* that initiate the pressure feed expansion of the honing tools in the manner previously described. It should be noted that closing of the contact relays 490*a* through *b* energizes the solenoids 416*a* through *h* through a set of hold relays 491, 492, 493, 494, 495, 496, 497, and 498 whose respective instantaneous contacts identified by the same reference numerals with subscripts a likewise close. Indicator lights 500 are also energized by the closing of contacts 490*a* through *h* so as to provide an indication that the honing tools are expanded.

When relay 488 shown in FIG. 12*a* times out, its normally closed contacts 488*b* open such that relay 490 is deenergized and contacts 490*a* through *h* then open so that the solenoids 416*a* through *h* remain energized only through the sizing switches 130*a* through *h* and the hold relays 491, 492, 493, 494, 495, 496, 497, and 498 and their closed contacts identified by the same reference numerals and the subscript *a*. Each of the solenoids 416*a* through *h* is thus maintained energized by the closed condition of the associated sizing 130*a* through *h* until the switches are individually opened as previously described when their associated bores being honed reach the required size. Timing out of the relay 488 also closes normally open time-delay contacts 488*c* so as to energize the solenoid 428 that actuages the master lock valve 426 for the mechanical lock cylinders 188*a* through *h* in order to lock their associated mechanical locks. Instantaneous contacts 488*d* of relay 488 that close when it is energized and the relays 488*c* thereof that close when it is timed out energize a relay 502 and the rack feed valve control solenoid 446 at the same time as the lock valve control relay 428. It will be recalled that the solenoid 446 actuates the beginning of the driving rack movement that starts the constant rate feed mechanism for the honing tools.

The relay 502 shown in FIG. 12*a* has instantaneous contacts 502*a* that close upon the initiation of the constant rate feed expansion of the honing tools. It will be recalled that the initial constant rate feed mechanism expansion is at a coarse rate for a predetermined extent of expansion whereupon the switch 220 closes and through the contact relays 502*a* energizes the solenoid 466 that begins the fine feed constant rate expansion in the manner previously described. The final honing takes place at this fine rate until the bores reach the required size.

As each bore being honed reaches its required size, the associated sizing switches 130*a* through *h* individually open to deenergize the solenoids 416*a* through *h* in order to unlock the mechanical locks in the manner previously discussed. As each switch 130*a* through *h* is opened, it also deenergizes the associated relay 491, 492, 493, 494, 495, 496, 497, and 498 whose normally closed contacts of like reference numeral indication with the subscript *b* then close and upon closure of the last set of such contacts, a control relay 504 is energized through the sets of closed contacts and the timed out contacts 488*c* which have been closed and remain closed as long as relay 488 is energized. Relay 504 has instantaneous contacts 504*a* which maintain actuation thereof during the final tool re-expand honing operation previously discussed in connection with the description of the hydraulic circuitry. Relay 504 has normally open time-delay operated contacts 504*b*, 504*c*, 504*d* that close when this relay times out and also has normally closed time-delay contacts 504*e* that open when it times out. The time-delay operation of relay 504 allows the last honing tool to complete its unlocking and tool contraction before the re-expand cycle begins.

The final re-expansion begins when the relay 504 shown in FIG. 12*a* times out. The normally open time-delay operated contacts 504*b* then close to energize a shut-down relay 506 and at the same time the normally open time-delay contacts 504*c* and 504*d* close to energize the relay 490 and the solenoid 408. Contacts 590*a* through *h* of the relay 490 then close to energize the solenoids 416*a* through *h* which provide valve actuation for expanding the honing tools during the final honing. Solenoid 408 is actuated so as to provide the expansion of the tools at this time with a selected pressure that best suits the particular requirement. Opening of the contacts 504*e* when relay 504 times out prevents the lock solenoid 428 from initiating locking of the mechanical locks during the re-expand cycle. Relay 506 has normally closed time-delay operated contacts 506*a* and 506*b* that open to terminate the machine cycle when this relay times out. Opening of the contacts 506*a* deenergizes the solenoid 362 in order to terminate the stroking movement of the spindle head while opening of the contacts 506*b* deenergizes the spindle drive motor 232 and the relay 486. Opening of the contacts 486*b* of relay 486 as it is deenergized also deenergizes the relay 488 so that contacts 488*a* deenergize the relay 490 to close its contacts 490*a* through *h* and initiate the final contraction of the tools by deenergizing the solenoids 416*a* through *h*. Contacts 488*c* open to deenergize the relay 504 which in turn through the opening of its contacts 504*a* then deenergizes the shut-down relay 506. The circuit is then ready for another cycle which is then actuated by closing of the switch 484 as previously discussed.

While a preferred embodiment of a honing maching incorporating apparatus according to this invention has herein been described in detail, various alternative embodiments and designs are possible for practicing the present invention as defined by the following claims.

What is claimed is:

1. In a multiple spindle honing machine including a base, a spindle head mounted on the base for reciprocally driven movement with respect thereto, a plurality of rotatable spindles mounted on the head for reciprocation therewith, each spindle including an expandable and contractable honing tool for simultaneously machining a plurality of bores, and a drive train for rotating the spindles, improved feed apparatus comprising: feed cylinders mounted on the head in respective association with the honing tools; each spindle including a connector that connects one of the feed cylinders and the associated honing tool such that operation of the feed cylinders provides an initial expansion of the tools after insertion thereof into the bores; mechanical locks for respectively locking the feed cylinders after the initial tool expansion; a constant rate feed mechanism for continuing to expand all of the tools after the feed cylinders are locked; and control means for individually sensing the size of each bore being machined and for operating the associated mechanical lock to unlock the feed cylinder controlled thereby to allow the feed cylinder to contract the tool independently of each other tool when the bore has been machined to a predetermined size.

2. Apparatus as in claim 1 wherein each connector includes a first threaded member connected to the associated feed cylinder and a second threaded member which is threaded to the first member and connected to the associated honing tool, and the constant rate feed mechanism including an actuating member which interconnects the second threaded members of the connectors and provides unthreading thereof from their associated first threaded members to expand the honing tools.

3. Apparatus as in claim 2 wherein each mechanical lock includes a lock member that locks the first threaded member of the associated connector against movement.

4. Apparatus as in claim 3 wherein the mechanical locks each include an actuating cylinder connected to the lock member thereof.

5. Apparatus as in claim 4 wherein each lock member includes a pivotal support and a locking end on one side of the pivotal support as well as a connection end connected to the actuating cylinder thereof on the other side of the pivotal support.

6. Apparatus as in claim 5 further including a housing on the head for supporting the first threaded member of each connector, and each lock including an axial force isolator interposed between the locking end of the lock member thereof and the first threaded member whose movement is controlled by the mechanical lock.

7. Apparatus as in claim 6 wherein each first threaded member includes a mounting portion that is slidably supported within the housing on the spindle head and engaged by the force isolator under the operation of the mechanical lock thereof to control movement of the connector by operation of the associated feed cylinder.

8. Apparatus as in claims 2 or 7 wherein each second threaded member includes gear teeth and the actuating member of the constant rate feed mechanism comprising a rack which is meshed with the gear teeth of each second threaded member to provide unthreading thereof from the associated first threaded member so as to expand the tools after the mechanical locks are locked.

9. Apparatus as in claim 8 wherein each spindle includes a rotatable drive member which rotatably drives the associated honing tool, said drive members each including an opening through which the connector extends and the spindle drive train including gears coupled with the drive members and driven in coordination with each other to rotate the tools.

10. In a multiple spindle honing machine including a base, a spindle head mounted on the base for reciprocally driven movement with respect thereto, a plurality of rotatable spindles mounted on the head for reciprocation therewith, each spindle including an expandable and contractable honing tool for simultaneously machining a plurality of bores, and a drive train for rotating the spindles, improved feed apparatus comprising: feed cylinders mounted on the head in respective association with the honing tools; each spindle including a connector having a first threaded member connected to one of the feed cylinders and a second threaded member which is threaded onto the first threaded member thereof and connected to the associated honing tool such that operation of the feed cylinders provides an initial expansion of the tools upon insertion thereof into the bores; mechanical locks mounted on the head and respectively associated with the connectors; each lock including a lock member and a time delay operated actuator for locking the lock member to prevent movement of the first threaded member of the connector; a constant rate feed mechanism including an actuating member coupled with the second threaded member of each connector and operable to provide unthreading thereof after locking of the lock member so as to continue the tool expansion at a constant rate; and control means for individually sensing the size of each bore being machined and for operating the actuator of the associated mechanical lock to unlock the first threaded member of the connector and thereby allow the feed cylinder to contract the tool independently of each other tool when the bore has been machined to a predetermined size.

11. Apparatus as in claim 10 wherein the second threaded member of each connector includes gear teeth; the actuating member of the constant rate feed mechanism comprising a rack meshed with the gear teeth of the second threaded member of each connector, and an operating cylinder for moving the rack to rotate the gears and the second threaded members in order to provide tool expansion.

12. Apparatus as in claim 11 further including a sensor for sensing the extent of rack movement and for controlling the rack operating cylinder to switch from an initial coarse feed to a fine feed.

13. Apparatus as in claim 11 wherein the sensor includes a control switch mounted on the head to control the rack operating cylinder and a switch actuator mounted on the rack to operate the control switch upon a predetermined extent of rack movement.

14. Apparatus as in claim 13 wherein the control switch actuator includes an adjustable connection for mounting thereof on the rack.

15. Apparatus as in claims 10 or 14 wherein each mechanical lock includes an axial force isolator interposed between the lock member of each lock and the first threaded member of the connector controlled thereby, and an actuator of each lock comprising a cylinder connected to its lock member.

16. Apparatus as in claim 15 wherein each lock member includes an intermediate portion having a pivotal support on the spindle head and a locking end on one side of the pivotal support as well as a connection end connected to the lock actuator cylinder on the other side of the pivotal support.

17. Apparatus as in claim 16 wherein the locking end of each lock member includes a curved surface engaged with the force isolator, and the first threaded member of each connector having a mounting portion slidably supported by the spindle head and engaged by the force isolator under the operation of the associated mechanical lock to control movement of the connector by operation of the associated feed cylinder.

18. Apparatus as in claim 17 wherein the spindle head includes a housing having housing portions for respectively mounting the first threaded member of each connector, each lock actuator cylinder being mounted externally on the associated connector housing portion of the spindle head, the force isolators of each lock being engaged with the mounting portion of the first threaded member within the associated housing portion, and each housing portion having an opening through which the lock member extends between the force isolator and the lock actuator cylinder.

19. Apparatus as in claim 18 wherein each spindle includes a rotatable drive member having a gear driven end and an end connected to the associated honing tool, each drive member having a central opening through which the tool connector extends, gears on the spindle head meshed with the driven ends of the tool drive members, and a rotatable ball spline on the machine base for rotating the gears as the spindle head is reciprocated.

20. In a multiple spindle honing machine including a base, a spindle head mounted on the base for reciprocally driven movement with respect thereto, a plurality of rotatable spindles mounted on the head for reciprocation therewith, each spindle including an expandable and contractable honing tool for simultaneously machining a plurality of bores, and a drive train for rotating the spindles, improved feed apparatus comprising: feed cylinders mounted on the head in respective association with the honing tools; each spindle including a connector that connects one of the feed cylinders and the associated honing tool such that operation of the feed cylinders provides an initial expansion of the tools upon insertion thereof into the bores; mechanical locks for respectively locking the feed cylinders after the initial tool expansion; a constant rate feed mechanism for continuing to expand all of the tools with the feed cylinders locked; control means for individually sensing the size of each bore being machined and for operating the associated mechanical lock to unlock the feed cylinder controlled thereby to allow the feed cylinder to contract the tool independently of each other tool when the bore has been machined to a predetermined size, and said control means including an electrical circuit having circuitry for sensing when all of the tools are unlocked and thereupon actuating all of the feed cylinders to re-expand the tools and finish the holes.

21. Apparatus as in claim 20 wherein the control circuit further includes electrical circuitry for initially actuating the feed cylinders to expand the tools and for actuating locking of the mechanical locks a predetermined period of time after the initial tool expansion.

22. Apparatus as in claim 21 wherein the electrical control circuit further includes electrical circuitry for actuating the constant rate feed mechanism after a predetermined extent of operation thereof so as to switch from a coarse to a fine feed rate.

23. Apparatus as in claim 20 wherein the control means includes wear indicators for sensing when the honing tools have worn a predetermined extent.

24. Apparatus as in claim 23 wherein the wear indicators are responsive to movement of feed cylinders.

25. In a multiple spindle honing machine including a base, a spindle head mounted on the base for reciprocally driven movement with respect thereto, a plurality of rotatable spindles mounted on the head for reciprocation therewith, each spindle including an expandable and contractable honing tool for machining a bore, and a drive train for rotating the spindles, improved feed apparatus comprising: pressure feed actuators respectively associated with the spindles; a constant rate feed mechanism; threaded connectors respectively associated with the spindles; each connector including a first threaded member connected to the associated pressure feed actuator; each connector also including a second threaded member which is threaded onto the first threaded member thereof and connected to the associated tool; mechanical locks for locking the first threaded members against movement after the pressure feed actuators initially expand the tools; and a constant rate feed mechanism including an actuating member which unthreads the second threaded members of each connector from the first threaded members thereof after the pressure feed actuators initially expand the honing tools.

26. Apparatus as in claim 25 wherein the pressure feed actuators comprise hydraulic cylinders and the actuating member of the constant rate feed mechanism comprising a hydraulically driven gear rack that meshes with the second members of the connectors to provide unthreading thereof from the first threaded members.

27. Apparatus as in claim 26 wherein the mechanical locks comprise hydraulic cylinders and locking members operated thereby for locking and unlocking the first threaded members of the connectors, the mechanical locks being operable to individually unlock the first threaded members after the bore being machined by the associated tool reaches the required size, and the hydraulic feed cylinders each being operable to contract the associated tool upon unlocking of the first threaded member of its connector.

28. Apparatus as in claim 27 further including electrical and hydraulic circuits for controlling operation of the pressure feed cylinders, the gear rack of the constant rate feed mechanism, and the mechanical locks.

29. Apparatus as in claim 28 wherein the electrical and hydraulic circuits include circuitry for re-expanding the tools under the impetus of the pressure feed cylinders so as to finish the bores after unlocking of the locks and contracting of the tools.

30. Apparatus as in claim 29 wherein the hydraulic circuit includes lock valves respectively associated with the lock cylinders and operated by pressurized hydraulic fluid which also operates the associated pressure feed cylinder, and a master lock valve that controls the flow of hydraulic fluid to the lock valves.

31. Apparatus as in claim 30 wherein the hydraulic circuit further includes cylinder feed valves for respectively feeding pressurized hydraulic fluid to the pressure feed cylinders, and the hydraulic circuit also including first and second rack feed valves for controlling movement of the gear rack at coarse and fine rates.

32. Apparatus as in claim 31 wherein the hydraulic circuit includes a cylinder that moves the rack, the first and second rack feed valves controlling fluid flow from the rack cylinder, and a rack control valve for controlling fluid flow to the rack cylinder.

* * * * *